US010005655B2

(12) United States Patent
Broen et al.

(10) Patent No.: US 10,005,655 B2
(45) Date of Patent: Jun. 26, 2018

(54) MODULAR BEVERAGE AND ICE DISPENSING UNIT

(71) Applicant: PepsiCo, Inc., Purchase, NY (US)

(72) Inventors: Martin E. Broen, New York, NY (US); Stephen Lim, Chappaqua, NY (US); Christian Stolarz, Brooklyn, NY (US)

(73) Assignee: PepsiCo, Inc., Purchase, NY (US)

( * ) Notice: Subject to any disclaimer, the term of this patent is extended or adjusted under 35 U.S.C. 154(b) by 0 days. days.

(21) Appl. No.: 15/114,024

(22) PCT Filed: Jan. 27, 2015

(86) PCT No.: PCT/US2015/013060

§ 371 (c)(1),
(2) Date: Jul. 25, 2016

(87) PCT Pub. No.: WO2015/113038

PCT Pub. Date: Jul. 30, 2015

(65) Prior Publication Data

US 2016/0340166 A1 Nov. 24, 2016

Related U.S. Application Data

(60) Provisional application No. 61/931,928, filed on Jan. 27, 2014.

(51) Int. Cl.
*B67D 1/06* (2006.01)
*B67D 1/08* (2006.01)
(Continued)

(52) U.S. Cl.
CPC ..... *B67D 1/06* (2013.01); *B67D 1/0888* (2013.01); *F21V 23/0471* (2013.01); *F25C 5/20* (2018.01); *B67D 2210/00034* (2013.01)

(58) Field of Classification Search
CPC .. B67D 1/06; B67D 2210/00034; F25C 5/002
(Continued)

(56) References Cited

U.S. PATENT DOCUMENTS 2,294,118 A * 8/1942 Leary ..... B67D 1/06 222/173
4,669,695 A * 6/1987 Chou ..... A47B 97/00 248/154

(Continued)

FOREIGN PATENT DOCUMENTS

| | | | |
|---|---|---|---|
| JP | 2009227332 | A | 10/2009 |
| WO | 03042612 | A2 | 5/2003 |
| WO | 2014189839 | A1 | 11/2014 |

OTHER PUBLICATIONS

International Search Report and the Written Opinion of the International Searching Authority for International Application No. PCT/US2015/013060, ISA/US, dated May 6, 2015, 7 pages.

(Continued)

*Primary Examiner* — Donnell Long
(74) *Attorney, Agent, or Firm* — Sterne, Kessler, Goldstein & Fox P.L.L.C.

(57) ABSTRACT

A modular dispensing unit comprising a frame having a front side, back side, two sidewalls, a top wall, an intermediate wall and a bottom wall; a first enclave and a second enclave within the frame; a first beverage dispenser located in the first enclave; a second beverage dispenser located in the second enclave; an ice dispenser positioned between the first and second enclaves; and an ice dispenser housing surrounding substantially the entire ice dispenser. The ice dispenser housing may have two sidewalls and a front wall, the front wall having an opening allowing access to an ice outlet of the ice dispenser.

19 Claims, 16 Drawing Sheets

(51) Int. Cl.
*F21V 23/04* (2006.01)
*F25C 5/20* (2018.01)

(58) Field of Classification Search
USPC ..... 222/173, 146.6, 52
See application file for complete search history.

(56) References Cited

U.S. PATENT DOCUMENTS

| | | | | |
|---|---|---|---|---|
| 5,112,477 | A * | 5/1992 | Hamlin | B01D 61/08 210/102 |
| 5,192,003 | A * | 3/1993 | Billings | B67D 1/0084 222/129.1 |
| 6,093,312 | A | 7/2000 | Boulter | |
| 6,176,562 | B1 * | 1/2001 | Hart | B67D 1/06 248/678 |
| 6,234,354 | B1 * | 5/2001 | Phillips | B67D 1/0021 222/129.1 |
| 6,948,831 | B1 | 9/2005 | Naqvi | |
| 2003/0089423 | A1 * | 5/2003 | Barton | A23G 9/28 141/198 |
| 2003/0155031 | A1 | 8/2003 | Barton et al. | |
| 2011/0301768 | A1 | 12/2011 | Hammonds et al. | |
| 2014/0299630 | A1 * | 10/2014 | Brown | B67D 1/06 222/129.1 |

OTHER PUBLICATIONS

Extended European Search Report issued in European Patent Application No. 15739926.2, dated Aug. 9, 2017, 8 pages.

* cited by examiner

MODULAR BEVERAGE AND ICE DISPENSING UNIT

This application claims priority to U.S. Provisional Patent Application No. 61/931,928, filed on Jan. 27, 2014. The present application claims priority to and the benefit of the above-identified application and is incorporated herein in its entirety.

BACKGROUND

Various beverage dispensing systems, such as those found in restaurants, gas stations, convenience stores, theaters and other entertainment and/or food service venues, typically have either a "drop in" dispenser apparatus or a countertop type dispenser apparatus. In a drop in dispenser apparatus, the dispenser apparatus is self-contained and may be dropped into an aperture of a countertop. In a countertop type dispenser apparatus, the dispenser apparatus is placed on a countertop. In conventional beverage dispensers, a dispensing head is coupled to a particular drink syrup supply source via a single pipe dedicated to supply the particular drink syrup to that dispensing head, wherein the particular drink syrup supply source is typically located near the counter top, i.e., directly under the counter top, or directly over the counter top.

The conventional beverage dispenser generally provides information about the available drinks using signage or labels for each type of drink. As the number of available drinks increases, it becomes more difficult to provide information related to the available drinks to a user.

Typically, ice and beverage dispensers are placed in or on a countertop among various other products and supplies. Conventional ice dispensers are large and unsightly and thus, often become the focal point of the consumer. With the onslaught of beverage information, chaotic dispenser location and numerous equipment and supply distractions, the consumer is overwhelmed and branding opportunities are lost.

Accordingly, there exists a need for an improved ice and beverage dispensing system that more effectively provides information related to the available products and better frames the consumer experience.

BRIEF SUMMARY

This Summary is provided to introduce a selection of concepts in a simplified form that are further described below in the Detailed Description. This Summary is not intended to identify key or essential features of the invention.

Modular ice and beverage dispensing units which frame the consumer experience, minimize consumer distractions and maximize consumer focus on the available products are disclosed. In various embodiments, modular dispensing units create a cohesive beverage dispensing experience and hide the size (i.e. the width, depth and height) of the ice dispenser without any loss of functionality.

In various embodiments, a modular dispensing unit including a frame that has a front side, back side, two sidewalls, a top wall, an intermediate wall and a bottom wall is provided. The frame has a first enclave and a second enclave within the frame, with a first beverage dispenser located in the first enclave and a second beverage dispenser located in the second enclave. An ice dispenser is positioned between the first enclave and the second enclave, and an ice dispenser housing surrounds substantially the entire ice dispenser.

In other embodiments, a modular dispensing unit including a frame that has a front side, back side, two sidewalls, a top wall, an intermediate wall and a bottom wall is provided. The frame has a first enclave and a second enclave within the frame, with a first beverage dispenser located in the first enclave and a second beverage dispenser located in the second enclave. An ice dispenser is positioned between the first enclave and the second enclave, and an ice dispenser housing surrounds the ice dispenser. The ice dispenser housing has two housing sidewalls and a front wall, the front wall having an opening that allows access to an ice outlet of the ice dispenser.

In further embodiments, a modular dispensing unit including a frame that has a front side, back side, two sidewalls, a top wall, an intermediate wall and a bottom wall is provided. The intermediate wall, two sidewalls and top wall are of unitary construction. The frame has a first enclave and a second enclave within the frame, with a first beverage dispenser located in the first enclave and a second beverage dispenser located in the second enclave. An ice dispenser is positioned between the first enclave and the second enclave, and an ice dispenser housing surrounds the ice dispenser. The ice dispenser housing has two housing sidewalls and a front wall, the front wall having an opening that allows access to an ice outlet of the ice dispenser. The ice dispenser housing is the same or similar color as the wall of the venue when the modular dispensing unit is installed adjacent to or embedded in the wall of the venue.

Additional embodiments are described herein.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

The various embodiments are not limited to particular embodiments described herein. Further, the terminology used herein is for the purpose of describing particular embodiments only, and is not intended to be limiting.

Figure 1:
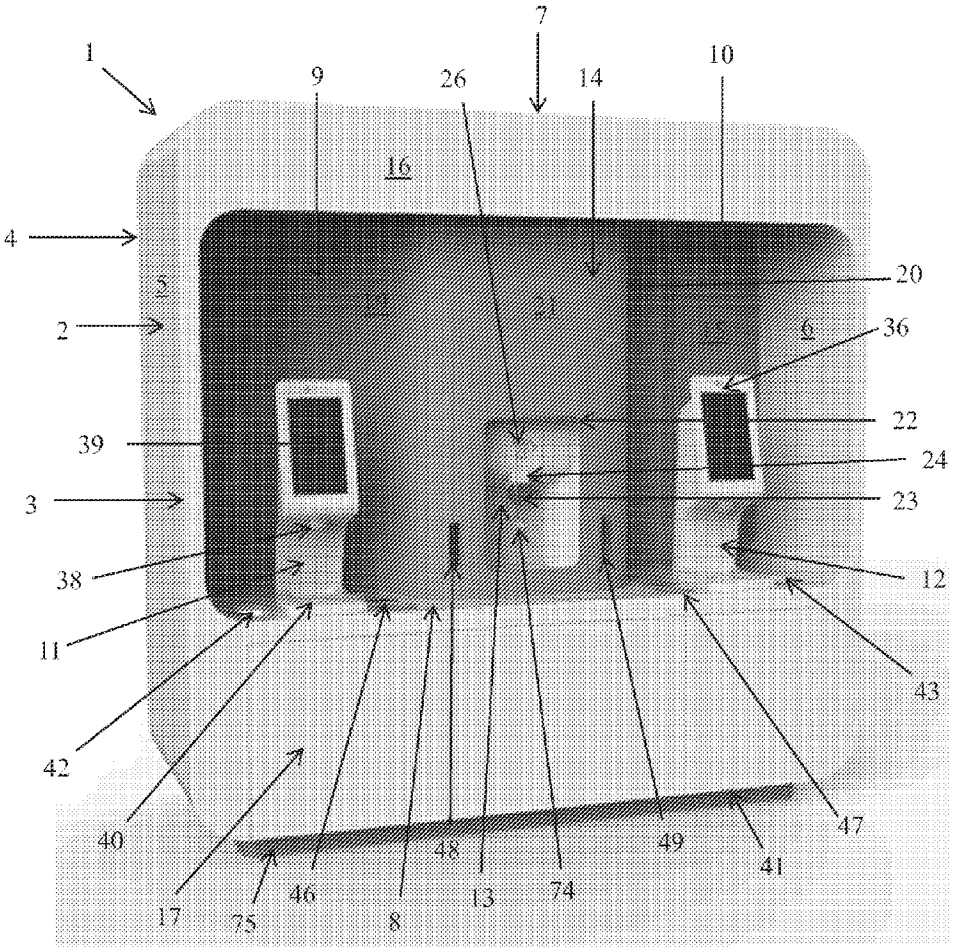
FIG. 1 illustrates a modular dispensing unit according to one or more embodiments.

FIG. 1 illustrates modular dispensing unit 1 according to one or more embodiments. Modular dispensing unit 1 has a frame 2 having a front side 3, back side 4, two sidewalls 5 and 6, a top wall 7, an intermediate wall 8 and a bottom wall 41. A first enclave 9 and a second enclave 10 are situated within frame 2. A first beverage dispenser 11 is located in first enclave 9. A second beverage dispenser 12 is located in second enclave 10. An ice dispenser 13 is positioned between first enclave 9 and second enclave 10. An ice dispenser housing 14 surrounds substantially the entire ice dispenser 13. Ice dispenser housing 14 may have two housing sidewalls 19 and 20 and a front wall 21, with front wall 21 having an opening 22 that allows access to an ice outlet 23 of ice dispenser 13. Ice dispenser housing 14 may also have a lid 27, so that ice may be loaded into ice dispenser 13. An integrated bezel/nozzle cover 24 may at least partially cover ice outlet 23 of ice dispenser 13. Ice dispenser housing 14 may further have a window 26 for a graphic treatment, advertisement, logo, brand name, or design 36. A lever 74, either existing from ice dispenser 13 or a part of ice dispenser housing 14, is accessible through opening 22.

Frame 2, including front side 3, back side 4, two sidewalls 5 and 6, top wall 7, intermediate wall 8 and bottom wall 41, and ice dispenser housing 14 may be constructed of any suitable materials. Exemplary materials include, but are not limited to, stainless steel, aluminum, plastic, wood and combinations thereof. In some embodiments, the entire frame 2 and/or ice dispenser housing 14 may be made from plastic. In other embodiments, the entire frame 2 and/or ice dispenser housing 14 may be made from stainless steel. In further embodiments, the entire frame 2 and/or ice dispenser housing 14 may be made from aluminum. In yet other embodiments, intermediate wall 8 is stainless steel and the remainder of frame 2 and/or ice dispenser housing 14 is plastic. In still further embodiments, intermediate wall 8 is aluminum and the remainder of frame 2 and/or ice dispenser housing 14 is plastic. In certain embodiments, frame 2 and/or ice dispenser housing 14 may be made from stainless steel, aluminum and plastic.

Bottom wall 41, intermediate wall 8, two sidewalls 5 and 6, top wall 7 and ice dispenser housing 14 of modular dispensing unit 1 may be of unitary construction, singular construction, or a combination thereof. In certain embodiments, bottom wall 41, intermediate wall 8, two sidewalls 5 and 6 and top wall 7 of modular dispensing unit 1 are of unitary construction. In further embodiments, bottom wall 41, intermediate wall 8, two sidewalls 5 and 6, top wall 7 and ice dispenser housing 14 of modular dispensing unit 1 are of unitary construction. In some embodiments, intermediate wall 8, two sidewalls 5 and 6 and top wall 7 of modular dispensing unit 1 are of unitary construction. A non-limiting example is illustrated in FIG. 1. In other embodiments, bottom wall 41, intermediate wall 8, two sidewalls 5 and 6, top wall 7 and ice dispenser housing 14 of modular dispensing unit 1 are of singular construction. In further embodiments, some of frame 2 components may be of unitary construction while other components are of singular construction. For example, intermediate wall 8 and two sidewalls 5 and 6 of modular dispensing unit 1 may be of unitary construction, while top wall 7 is of singular construction. In other embodiments, top wall 7 and two sidewalls 5 and 6 of modular dispensing unit 1 may be of unitary construction, while intermediate wall 8 is of singular construction. In certain embodiments, intermediate wall 8, two sidewalls 5 and 6, top wall 7 and ice dispenser housing 14 are of unitary construction. In various embodiments, ice dispenser housing 14 is a prefabricated unit that may be installed in a frame 2 comprising an intermediate wall 8, two sidewalls 5 and 6 and top wall 7 of unitary construction. In other embodiments, ice dispenser housing 14 is a prefabricated unit that may be installed in a frame 2 comprising an intermediate wall 8, two sidewalls 5 and 6 and top wall 7 of singular construction.

In certain embodiments, modular dispensing unit 1 has a storage area 17 located underneath intermediate wall 8. Storage area 17 is not particularly limited. For example, storage area 17 may comprise cabinets, shelves or a combination thereof. Storage area 17 may be used to house beverage supplies (i.e. straws, lids, cups, etc.), beverage ingredients, carbon dioxide, ice dispenser equipment, beverage dispenser equipment, cooling equipment, trash or combinations thereof.

In various embodiments, back side 4 comprises a back wall 15. Back wall 15, bottom wall 41, intermediate wall 8, two sidewalls 5 and 6, top wall 7, storage area 17 and ice dispenser housing 14 of modular dispensing unit 1 may be of unitary construction, singular construction, or a combination thereof. In certain embodiments, the various individual components of modular dispensing unit 1 (i.e. back wall 15, bottom wall 41, intermediate wall 8, two sidewalls 5 and 6, top wall 7, storage area 17 and ice dispenser housing 14) may be made-up of sub-components. For example, in some embodiments, top wall 7 may comprise two or more sub-top wall components. In other embodiments, back wall 15 may comprise two or more sub-back wall components. In further embodiments, bottom wall 41 may comprise two or more sub-bottom wall components. In certain embodiments, intermediate wall 8 may comprise two or more sub-intermediate wall components. In other embodiments, two sidewalls 5 and 6 may comprise two or more sub-sidewall components. In further embodiments, storage area 17 may comprise two or more sub-storage area components. In still other embodiments, ice dispenser housing 14 may comprise two or more sub-ice dispenser housing components.

In one or more embodiments, bottom wall 41, storage area 17, back wall 15, intermediate wall 8, two sidewalls 5 and 6 and top wall 7 of modular dispensing unit 1 are of unitary construction. In certain embodiments, back wall 15, intermediate wall 8, two sidewalls 5 and 6 and top wall 7 of modular dispensing unit 1 are of unitary construction. In other embodiments, bottom wall 41, storage area 17, back wall 15, intermediate wall 8, two sidewalls 5 and 6 and top wall 7 of modular dispensing unit 1 are of singular construction. In further embodiments, some of frame 2 components may be of unitary construction while other components are of singular construction. For example, back wall 15, intermediate wall 8 and two sidewalls 5 and 6 of modular dispensing unit 1 may be of unitary construction, while top wall 7 is of singular construction. In other embodiments, back wall 15, top wall 7 and two sidewalls 5 and 6 of modular dispensing unit 1 may be of unitary construction, while intermediate wall 8 is of singular construction. In further embodiments, intermediate wall 8, two sidewalls 5 and 6 and top wall 7 of modular dispensing unit 1 are of unitary construction, while back wall 15 is of singular construction. In still further embodiments, back wall 15, intermediate wall 8 and top wall 7 are of unitary construction, while two sidewalls 5 and 6 are of singular construction.

In other embodiments, back side 4 comprises a back wall 15, and back wall 15 and ice dispenser housing 14 are of unitary construction. In further embodiments, intermediate wall 8, two sidewalls 5 and 6, top wall 7 and ice dispenser housing 14 are of unitary construction.

In some embodiments, top wall 7 may further comprise a first spotlight 68 (not shown in FIG. 1, see FIG. 14) located above first beverage dispenser 11 and a second spotlight 69 (not shown in FIG. 1, see FIG. 14) located above second beverage dispenser 12. In certain embodiments, first spotlight 68 (not shown in FIG. 1, see FIG. 14) and second spotlight 69 (not shown in FIG. 1, see FIG. 14) are recessed in top wall 7. First spotlight 68 (not shown in FIG. 1, see FIG. 14) and second spotlight 69 (not shown in FIG. 1, see FIG. 14) are not limited to any particular kind of light.

In further embodiments, modular dispensing unit 1 may further comprise a motion detector that activates first spotlight 68 (not shown in FIG. 1, see FIG. 14) above first beverage dispenser 11 based on the presence of a user in front of first beverage dispenser 11. In other embodiments, modular dispensing unit 1 may further comprise a gesture detector that activates first spotlight 68 (not shown in FIG. 1, see FIG. 14) above first beverage dispenser 11 based on one or more gestures made by a user in front of first beverage dispenser 11.

In some embodiments, modular dispensing unit 1 may further comprise a motion detector that activates second spotlight 69 (not shown in FIG. 1, see FIG. 14) above second beverage dispenser 12 based on the presence of a user in front of second beverage dispenser 12. In other embodiments, modular dispensing unit 1 may further comprise a gesture detector that activates second spotlight 69 (not shown in FIG. 1, see FIG. 14) above second beverage dispenser 12 based on one or more gestures made by a user in front of second beverage dispenser 12.

In some embodiments, intermediate wall 8 may comprise first recessed pocket(s) or container(s) 46 and second recessed pocket(s) or container(s) 47. First recessed pocket(s) or container(s) 46 and second recessed pocket(s) or container(s) 47 may be used, for example, to store and/or dispense straws, lids or cups below an upper surface of intermediate wall 8. First recessed pocket(s) or container(s) 46 and second recessed pocket(s) or container(s) 47 reduce clutter and further focus consumer attention on the available products. In certain embodiments, first recessed pocket(s) or container(s) 46 are positioned adjacent to first beverage dispenser 11 and second recessed pocket(s) or container(s) 47 are positioned adjacent to second beverage dispenser 12, allowing users of both first beverage dispenser 11 and second beverage dispenser 12 to easily and quickly access straws, lids, cups or combinations thereof, focus on the available products, and avoid interfering with the experience of other users.

In various embodiments, intermediate wall 8 may have a first trash receptacle opening 42 and second trash receptacle opening 43. In certain embodiments, first trash receptacle opening 42 is positioned adjacent to first beverage dispenser 11 and second trash receptacle opening 43 is positioned adjacent to second beverage dispenser 12, allowing users of both first beverage dispenser 11 and second beverage dispenser 12 to easily and quickly dispose of trash, focus on the available products, and avoid interfering with the experience of other users.

In certain embodiments, ice dispenser housing 14 may have a first napkin dispenser opening 48 and second napkin dispenser opening 49. In some embodiments, first napkin dispenser opening 48 is positioned adjacent to first beverage dispenser 11 and second napkin dispenser opening 49 is positioned adjacent to second beverage dispenser 12, allowing users of both first beverage dispenser 11 and second beverage dispenser 12 to easily and quickly access napkins, focus on the available products, and avoid interfering with the experience of other users. Napkin dispensers (not shown) may be located inside ice dispenser housing 14 adjacent first napkin dispenser opening 48 and second napkin dispenser opening 49.

In certain embodiments, modular dispensing unit 1 may further comprise a front panel 16 attached or connected to front side 3 via top wall 7 and/or sidewalls 5 and/or 6. Intermediate wall 8, two sidewalls 5 and 6, top wall 7 and front panel 16 of modular dispensing unit 1 may be of unitary construction, singular construction, or a combination thereof.

In various embodiments, modular dispensing unit 1 may further have an advertisement, logo, brand name, or design 36 (not shown in FIG. 1, see FIGS. 2, 3, 5, 6A, 7A, 7B, 13 and 14) located on or adjacent to modular dispensing unit 1. For example, an advertisement, logo, brand name, or design 36 (not shown in FIG. 1, see FIGS. 2, 3, 5, 6A, 7A, 7B, 13 and 14) may be located on or adjacent to bottom wall 41, front side 3, back side 4, back wall 15, sidewalls 5 and/or 6, top wall 7, intermediate wall 8, front panel 16, storage area 17, first beverage dispenser 11, second beverage dispenser 12, ice dispenser housing 14 or a combination thereof.

Base 75 may be positioned underneath bottom wall 41. In various embodiments, base 75 and bottom wall 41 may be of unitary construction or singular construction. In some embodiments base 75 is attached to bottom wall 41. In other embodiments, base 75 and bottom wall 41 are of unitary construction. In certain embodiments, base 75 may be attached to the floor of the venue. Examples of base 75 include, but are not limited to, a platform, wheels, casters, legs, pegs, blocks, or a combination thereof.

In various embodiments, ice dispenser housing 14 is not attached to ice dispenser 13. In certain embodiments, ice dispenser housing 14 is attached to back side 4, back wall 15, intermediate wall 8, two sidewalls 5 and/or 6, top wall 7, or a combination thereof. In some embodiments, ice dispenser housing 14 is attached to back side 4. In other embodiments, ice dispenser housing 14 is attached to back wall 15. In further embodiments, ice dispenser housing 14 is attached to intermediate wall 8. In still other embodiments, ice dispenser housing 14 is attached to two sidewalls 5 and 6. In still further embodiments, ice dispenser housing 14 is attached to top wall 7. In other embodiments, ice dispenser housing 14 is attached to a wall of the venue when modular dispensing unit 1 is installed in the venue.

Any suitable attachment mechanism may be used. Suitable attachment mechanisms include, but are not limited to, glue, epoxy, adhesive, tape, screws, nails, nuts and bolts, key pins, tongue and groove construction, welding, molding or combinations thereof.

In order to minimize the appearance of ice dispenser 13 and frame the consumer experience, ice dispenser housing 14 may be the same or similar color as a wall of the venue when modular dispensing unit 1 is installed in the venue. Matching the color of ice dispenser housing 14 to a wall of the venue allows ice dispenser 13 to essentially blend in with the wall of the venue. When ice dispenser housing 14 blends in with the wall of the venue, the consumer then focuses on the available products and branding information. A cohesive beverage dispensing experience is created and the size (i.e. the width, depth and height) of ice dispenser 13 is hidden without any loss of functionality. Further, when a frame 2 is present and ice dispenser housing 14 is the same or similar color as the wall of the venue, the consumer is less likely to be distracted by the chaos of the venue and equipment. In essence, the user experience becomes framed and the consumer is more able to focus on the available products.

In certain embodiments, ice dispenser housing 14 is the same or similar color as a covering positioned on or adjacent to the wall of the venue when modular dispensing unit 1 is installed in the venue. Such covering is not particularly limited. The covering may be, for example, made of paint, cloth/fabric, paper, plastic, metal, cardboard, paperboard or a combination thereof.

In certain embodiments, back side 4 comprises a back wall 15, and back wall 15 is the same or similar color as a wall of the venue when the modular dispensing unit is installed in the venue. In further embodiments, ice dispenser housing 14 and back wall 15 are the same or similar color as a wall of the venue when modular dispensing unit 1 is installed in the venue. In certain embodiments, ice dispenser housing 14 and back wall 15 are of unitary construction and are the same or similar color as a wall of the venue when modular dispensing unit 1 is installed in the venue.

In one or more embodiments, ice dispenser housing 14 and back wall 15 are the same or similar color as a covering positioned on or adjacent to the wall of the venue when modular dispensing unit 1 is installed in the venue. Such covering is not particularly limited. The covering may be, for example, made of paint, cloth/fabric, paper, plastic, metal, cardboard, paperboard or a combination thereof.

In some embodiments, frame 2 of modular dispensing unit 1, including front side 3, back side 4, two sidewalls 5 and 6, top wall 7, intermediate wall 8, storage area 17 and bottom wall 41, is the same or similar color as a wall of the venue when modular dispensing unit 1 is installed in the venue. The wall of the venue is not particularly limited. In various embodiments, the wall of the venue may be, for example, made of cloth/fabric, wood, drywall, concrete, bricks, metal, stone or a combination thereof.

In certain embodiments, frame 2 of modular dispensing unit 1, including front side 3, back side 4, two sidewalls 5 and 6, top wall 7, intermediate wall 8, storage area 17 and bottom wall 41, is the same or similar color as a covering positioned on or adjacent to the wall of the venue when modular dispensing unit 1 is installed in the venue. Such covering is not particularly limited. The covering may be, for example, made of paint, cloth/fabric, paper, plastic, metal, cardboard, paperboard or a combination thereof.

Modular dispensing unit 1 may be constructed and/or assembled off-site and then transported to an intended venue, constructed and/or assembled on-site, or a combination thereof. For example, in some embodiments, the entire modular dispensing unit 1 may be constructed and/or assembled off-site and then transported to the intended venue. In other embodiments, the entire modular dispensing unit 1 may be constructed and/or assembled on-site at the intended venue. In yet other embodiments, components of modular dispensing unit 1 (i.e. frame 2) may be constructed off-site, transported to the intended venue and then assembled with the remaining modular dispensing unit 1 components.

Exemplary venues include, but are not limited to, restaurants, gas stations, convenience stores, theaters, convention centers, shopping malls, sporting arenas and stadiums, airports, cafeterias and other entertainment and/or food service sites. In various embodiments, modular dispensing unit 1 may be installed on a wall of a venue, against a wall of a venue, adjacent to a wall of a venue, embedded in a wall of a venue or a combination thereof. In certain embodiments, frame 2 may define a wall of the venue. In other embodiments, frame 2 and a wall of the venue are of unitary construction. In some embodiments, upon installation, frame 2 becomes one with a wall of the venue.

In various embodiments, modular dispensing unit 1 is sized so that it may be easily transported and installed in the intended venue. For example, in some embodiments, modular dispensing unit 1 is sized so that a fully constructed and/or assembled unit may fit in an elevator.

Ice dispenser 13 is not limited to any particular ice dispensing machine. In certain embodiments, ice dispenser 13 has an ice storage unit, an ice making unit or a combination thereof. For example, in some embodiments, ice dispenser 13 stores and dispenses ice, but does not make the ice. In other embodiments, ice dispenser 13 makes, stores and dispenses the ice. In certain embodiments, ice dispenser 13 comprises an ice maker stacked on top of an ice storage and/or dispensing unit.

Placing ice dispenser 13 surrounded by ice dispenser housing 14 between first beverage dispenser 11 and second beverage dispenser 12 allows for a semi-private user experience and further focuses consumer attention on the available products. In various embodiments, ice dispenser housing 14 does not attach to ice dispenser 13. For example, in some embodiments, ice dispenser housing 14 may fit over ice dispenser 13 like a sleeve or around ice dispenser 13 like a mask. In certain embodiments, two housing sidewalls 19 and 20 are attached to a wall of the venue when modular dispensing unit 1 is installed in the venue. In other embodiments, ice dispenser housing 14 may attach to ice dispenser 13 at one or more attachment/anchoring points. In some embodiments, two housing sidewalls 19 and 20 are attached to back wall 15. In further embodiments, two housing sidewalls 19 and 20 and back wall 15 are of unitary construction.

First beverage dispenser 11 and second beverage dispenser 12 are not limited to any particular type of beverage dispenser. FIGS. 1, 2, 7A, 7B, 12 and 14 show first beverage dispenser 11 and second beverage dispenser 12 according to one or more embodiments. In certain embodiments, first beverage dispenser 11 and second beverage dispenser 12 may comprise towers having one or more dispensing heads 38 from which one or more beverages may be dispensed. First beverage dispenser 11 and second beverage dispenser 12 may dispense hot or cold beverages. In various embodiments, first beverage dispenser 11 and second beverage dispenser 12 may dispense carbonated beverages, soft drinks, sodas, colas, juices, teas, water or combinations thereof.

In certain embodiments, first beverage dispenser 11 and/or second beverage dispenser 12 may have drip pan 40 positioned below one or more dispensing heads 38. In various embodiments, first beverage dispenser 11 and/or second beverage dispenser 12 may further comprise screen 39 where the consumer may view information about the available products and the particular beverage ordered by the consumer. In certain embodiments, screen 39 is a touchscreen that allows the consumer to interact with first beverage dispenser 11 and/or second beverage dispenser 12. In various embodiments, first beverage dispenser 11 and/or second beverage dispenser 12 may further have an advertisement, logo, brand name, or design 36 located on first beverage dispenser 11 and/or second beverage dispenser 12.

First beverage dispenser 11 and second beverage dispenser 12 may further have lights. For example, in certain embodiments, first beverage dispenser 11 and/or second beverage dispenser 12 may have a light positioned adjacent to one or more dispensing heads 38, above one or more dispensing heads 38, below one or more dispensing heads 38, surrounding one or more dispensing heads 38, within one or more dispensing heads 38, or a combination thereof. Such lights are not limited to any particular kind of light.

In further embodiments, modular dispensing unit 1 may further comprise a motion detector that activates a first beverage dispenser light, such light positioned adjacent to one or more dispensing heads 38 of first beverage dispenser 11, above one or more dispensing heads 38 of first beverage dispenser 11, below one or more dispensing heads 38 of first beverage dispenser 11, surrounding one or more dispensing heads 38 of first beverage dispenser 11, or within one or more dispensing heads 38 of first beverage dispenser 11, based on the presence of a user in front of first beverage dispenser 11. In other embodiments, modular dispensing unit 1 may further comprise a gesture detector that activates a first beverage dispenser light, such light positioned adjacent to one or more dispensing heads 38 of first beverage dispenser 11, above one or more dispensing heads 38 of first beverage dispenser 11, below one or more dispensing heads 38 of first beverage dispenser 11, surrounding one or more dispensing heads 38 of first beverage dispenser 11, or within one or more dispensing heads 38 of first beverage dispenser 11, based on one or more gestures made by a user in front of first beverage dispenser 11.

In further embodiments, modular dispensing unit 1 may further comprise a motion detector that activates a second beverage dispenser light, such light positioned adjacent to one or more dispensing heads 38 of second beverage dispenser 12, above one or more dispensing heads 38 of second beverage dispenser 12, below one or more dispensing heads 38 of second beverage dispenser 12, surrounding one or more dispensing heads 38 of second beverage dispenser 12, or within one or more dispensing heads 38 of second beverage dispenser 12, based on the presence of a user in front of second beverage dispenser 12. In other embodiments, modular dispensing unit 1 may further comprise a gesture detector that activates a second beverage dispenser light, such light positioned adjacent to one or more dispensing heads 38 of second beverage dispenser 12, above one or more dispensing heads 38 of second beverage dispenser 12, below one or more dispensing heads 38 of second beverage dispenser 12, surrounding one or more dispensing heads 38 of second beverage dispenser 12, or within one or more dispensing heads 38 of second beverage dispenser 12, based on one or more gestures made by a user in front of second beverage dispenser 12.

First beverage dispenser 11 and second beverage dispenser 12 may utilize any suitable dispensing technology. For example, first beverage dispenser 11 and second beverage dispenser 12 may use traditional fountain drink mixing and/or dispensing equipment and methods. The mixing and/or transferring equipment may be located in storage area 17 or in a remote location. For example, the mixing and/or transferring equipment may be located in a room inside the venue.

Figure 2:
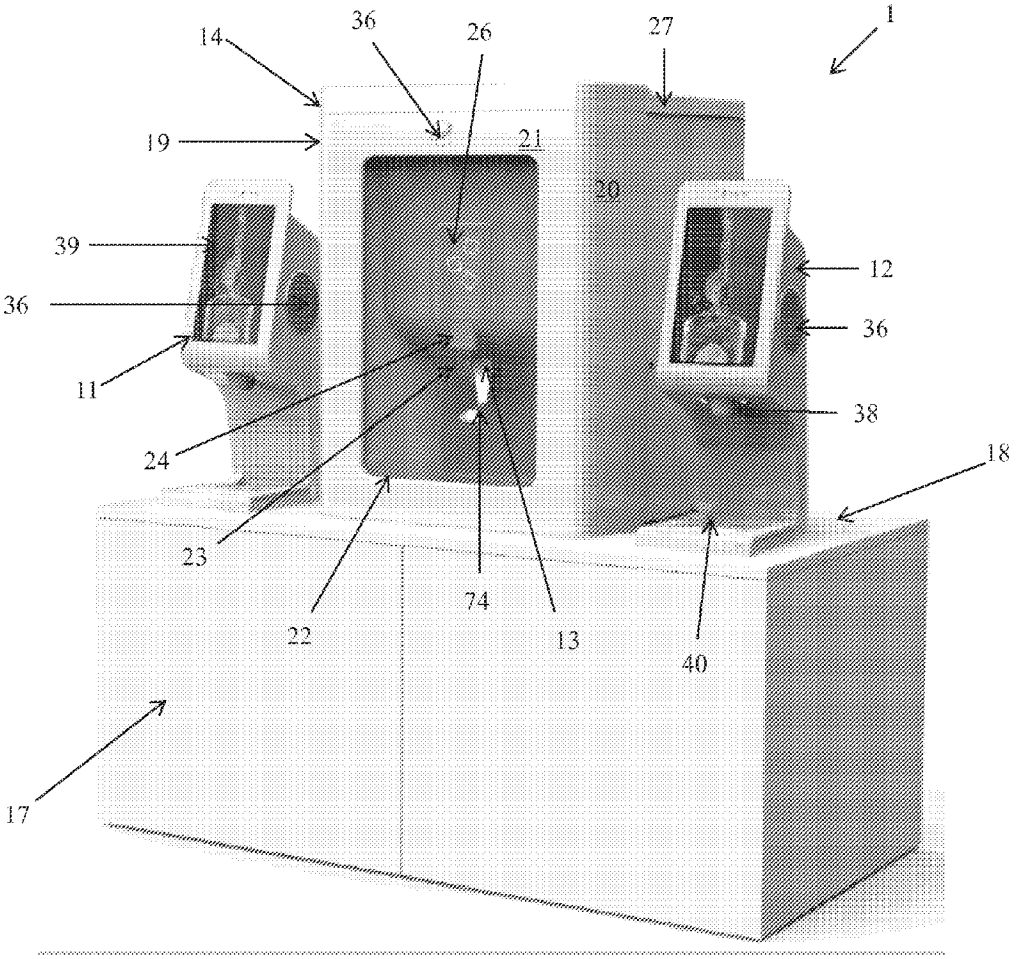
FIG. 2 illustrates a modular dispensing unit according to one or more embodiments.

FIG. 2 illustrates modular dispensing unit 1 according to another embodiment. Modular dispensing unit 1 may have a countertop 18 on which a first beverage dispenser 11, a second beverage dispenser 12 and an ice dispenser 13 are located. Ice dispenser 13 may be positioned between first beverage dispenser 11 and second beverage dispenser 12. An ice dispenser housing 14 surrounds substantially the entire ice dispenser 13. A storage area 17 is located underneath countertop 18.

Storage area 17 is not particularly limited. For example, storage area 17 may comprise cabinets, shelves or a combination thereof. Storage area 17 may be used to house beverage supplies (i.e. straws, lids, cups, etc.), beverage ingredients, carbon dioxide, ice dispenser equipment, beverage dispenser equipment, cooling equipment, trash or combinations thereof.

Ice dispenser housing 14 may have two housing sidewalls 19 and 20 and a front wall 21, with front wall 21 having an opening 22 that allows access to an ice outlet 23 of ice dispenser 13. Ice dispenser housing 14 may also have a lid 27, so that ice may be loaded into ice dispenser 13. An integrated bezel/nozzle cover 24 may at least partially cover ice outlet 23 of ice dispenser 13. Ice dispenser housing 14 may further have a window 26 for a graphic treatment, advertisement, logo, brand name, or design 36. A lever 74, either existing from ice dispenser 13 or a part of ice dispenser housing 14, is accessible through opening 22.

In various embodiments, countertop 18 may have a first trash receptacle opening 42 (not shown in FIG. 2, see FIGS. 1, 8, 9, 11A and 14) and second trash receptacle opening 43 (not shown in FIG. 2, see FIGS. 1, 8, 9, 11A and 14). In certain embodiments, first trash receptacle opening 42 (not shown in FIG. 2, see FIGS. 1, 8, 9, 11A and 14) is positioned adjacent to first beverage dispenser 11 and second trash receptacle opening 43 (not shown in FIG. 2, see FIGS. 1, 8, 9, 11A and 14) is positioned adjacent to second beverage dispenser 12, allowing users of both first beverage dispenser 11 and second beverage dispenser 12 to easily and quickly dispose of trash, focus on the available products, and avoid interfering with the experience of other users.

In some embodiments, countertop 18 may comprise first recessed pocket(s) or container(s) 46 (not shown in FIG. 2, see FIGS. 1, 8, 9, 10B, 10C, 11A and 14) and second recessed pocket(s) or container(s) 47 (not shown in FIG. 2, see FIGS. 1, 8, 9, 10B, 10C, 11A and 14). First recessed pocket(s) or container(s) 46 (not shown in FIG. 2, see FIGS. 1, 8, 9, 10B, 10C, 11A and 14) and second recessed pocket(s) or container(s) 47 (not shown in FIG. 2, see FIGS. 1, 8, 9, 10B, 10C, 11A and 14) may be used, for example, to store and/or dispense straws, lids or cups below an upper surface of countertop 18. First recessed pocket(s) or container(s) 46 (not shown in FIG. 2, see FIGS. 1, 8, 9, 10B, 10C, 11A and 14) and second recessed pocket(s) or container(s) 47 (not shown in FIG. 2, see FIGS. 1, 8, 9, 10B, 10C, 11A and 14) reduce clutter and further focus consumer attention on the available products. In certain embodiments, first recessed pocket(s) or container(s) 46 (not shown in FIG. 2, see FIGS. 1, 8, 9, 10B, 10C, 11A and 14) are positioned adjacent to first beverage dispenser 11 and second recessed pocket(s) or container(s) 47 (not shown in FIG. 2, see FIGS. 1, 8, 9, 10B, 10C, 11A and 14) are positioned adjacent to second beverage dispenser 12, allowing users of both first beverage dispenser 11 and second beverage dispenser 12 to easily and quickly access straws, lids, cups or combinations thereof, focus on the available products, and avoid interfering with the experience of other users.

In certain embodiments, ice dispenser housing 14 may have a first napkin dispenser opening 48 (not shown in FIG. 2, see FIGS. 1, 8, 9, 10A, 11B, 12 and 14) and second napkin dispenser opening 49 (not shown in FIG. 2, see FIGS. 1, 8, 9, 10A, 11B, 12 and 14). In some embodiments, first napkin dispenser opening 48 (not shown in FIG. 2, see FIGS. 1, 8, 9, 10A, 11B, 12 and 14) is positioned adjacent to first beverage dispenser 11 and second napkin dispenser opening 49 (not shown in FIG. 2, see FIGS. 1, 8, 9, 10A, 11B, 12 and 14) is positioned adjacent to second beverage dispenser 12, allowing users of both first beverage dispenser 11 and second beverage dispenser 12 to easily and quickly access napkins, focus on the available products, and avoid interfering with the experience of other users. Napkin dispensers (not shown) may be located inside ice dispenser housing 14 adjacent first napkin dispenser opening 48 (not shown in FIG. 2, see FIGS. 1, 8, 9, 10A, 11B, 12 and 14) and second napkin dispenser opening 49 (not shown in FIG. 2, see FIGS. 1, 8, 9, 10A, 11B, 12 and 14).

In various embodiments, ice dispenser housing 14 does not cover ice outlet 23 (i.e. an ice chute or nozzle) of ice dispenser 13. In certain embodiments, ice dispenser housing 14 is attached to countertop 18. In other embodiments, ice dispenser housing 14 and countertop 18 are of unitary construction. In other embodiments, ice dispenser housing 14, countertop 18 and storage area 17 are of unitary construction. In yet other embodiments, ice dispenser housing 14, countertop 18, storage area 17 or a combination thereof are attached to a wall of a venue when modular dispensing unit 1 is installed in the venue. In certain embodiments, ice dispenser housing 14 is attached to a wall of a venue when modular dispensing unit 1 is installed in the venue. In further embodiments, countertop 18 and/or storage area 17 are attached to a wall of a venue when modular dispensing unit 1 is installed in the venue. In other embodiments, ice dispenser housing 14, countertop 18 and storage area 17 are attached to a wall of a venue when modular dispensing unit 1 is installed in the venue.

Any suitable attachment mechanism may be used. Suitable attachment mechanisms include, but are not limited to, glue, epoxy, adhesive, tape, screws, nails, nuts and bolts, key pins, tongue and groove construction, welding, molding or combinations thereof.

Countertop 18 may be constructed of any suitable materials. Exemplary materials include, but are not limited to, stainless steel, aluminum, plastic, wood and combinations thereof. In some embodiments, countertop 18 may be made from plastic. In other embodiments, countertop 18 may be made from stainless steel. In further embodiments, countertop 18 may be made from aluminum. In yet other embodiments, countertop 18 is stainless steel and plastic. In still further embodiments, countertop 18 is aluminum and plastic.

In order to minimize the appearance and size of ice dispenser 13 and frame the consumer experience, ice dispenser housing 14 may be the same or similar color as a wall of the venue when modular dispensing unit 1 is installed in the venue. Matching the color of ice dispenser housing 14 allows ice dispenser 13 to essentially blend in with the wall of the venue. When ice dispenser housing 14 blends in with the wall of the venue, the consumer then focuses on the available products and branding information. Further, when ice dispenser housing 14 is the same or similar color as the wall of the venue, the consumer is less likely to be distracted by the chaos of the venue and equipment. In essence, the consumer is more able to focus on the available products.

In some embodiments, ice dispenser housing 14 is the same or similar color as a covering positioned on or adjacent to the wall of the venue when modular dispensing unit 1 is installed in the venue. Such covering is not particularly limited. The covering may be, for example, made of paint, cloth/fabric, paper, plastic, metal, cardboard, paperboard or a combination thereof.

Modular dispensing unit 1 may be constructed and/or assembled off-site and then transported to an intended venue, constructed and/or assembled on-site, or a combination thereof. For example, in some embodiments, the entire modular dispensing unit 1 may be constructed and/or assembled off-site and then transported to the intended venue. In other embodiments, the entire modular dispensing unit 1 may be constructed and/or assembled on-site at the intended venue. In yet other embodiments, components of modular dispensing unit 1 may be constructed off-site, transported to the intended venue and then assembled with the remaining modular dispensing unit 1 components.

Exemplary venues include, but are not limited to, restaurants, gas stations, convenience stores, theaters, convention centers, shopping malls, sporting arenas and stadiums, airports, cafeterias and other entertainment and/or food service sites. In various embodiments, modular dispensing unit 1 may be installed on a wall of a venue, against a wall of a venue, adjacent to a wall of a venue, embedded in a wall of a venue or a combination thereof. In certain embodiments, modular dispensing unit 1 may define a wall of the venue. In other embodiments, modular dispensing unit 1 and a wall of the venue are of unitary construction. In some embodiments, upon installation, modular dispensing unit 1 becomes one with a wall of the venue.

In various embodiments, modular dispensing unit 1 is sized so that it may be easily transported and installed in the intended venue. For example, in some embodiments, modular dispensing unit 1 is sized so that a fully constructed and/or assembled unit may fit in an elevator.

Ice dispenser 13 is not limited to any particular ice dispensing machine. In certain embodiments, ice dispenser 13 has an ice storage unit, an ice making unit or a combination thereof. For example, in some embodiments, ice dispenser 13 stores and dispenses ice, but does not make the ice. In other embodiments, ice dispenser 13 makes, stores and dispenses the ice. In certain embodiments, ice dispenser 13 comprises an ice maker stacked on top of an ice storage and/or dispensing unit.

Placing ice dispenser 13 surrounded by ice dispenser housing 14 between first beverage dispenser 11 and second beverage dispenser 12 allows for a semi-private user experience and further focuses consumer attention on the available products. In various embodiments, ice dispenser housing 14 does not attach to ice dispenser 13. For example, in some embodiments, ice dispenser housing 14 may fit over ice dispenser 13 like a sleeve or around ice dispenser 13 like a mask. In certain embodiments, two housing sidewalls 19 and 20 are attached to a wall of the venue when modular dispensing unit 1 is installed in the venue. In other embodiments, ice dispenser housing 14 may attach to ice dispenser 13 at one or more attachment/anchoring points.

First beverage dispenser 11 and second beverage dispenser 12 are not limited to any particular type of beverage dispenser. FIGS. 1, 2, 7A, 7B, 12 and 14 show first beverage dispenser 11 and second beverage dispenser 12 according to one or more embodiments. In certain embodiments, first beverage dispenser 11 and second beverage dispenser 12 may comprise towers having one or more dispensing heads 38 from which one or more beverages may be dispensed. First beverage dispenser 11 and second beverage dispenser 12 may dispense hot or cold beverages. In various embodiments, first beverage dispenser 11 and second beverage dispenser 12 may dispense carbonated beverages, soft drinks, sodas, colas, juices, teas, water or combinations thereof.

In certain embodiments, first beverage dispenser 11 and/or second beverage dispenser 12 may have drip pan 40 positioned below one or more dispensing heads 38. In various embodiments, first beverage dispenser 11 and/or second beverage dispenser 12 may further comprise screen 39 where the consumer may view information about the available products and the particular beverage ordered by the consumer. In certain embodiments, screen 39 is a touchscreen that allows the consumer to interact with first beverage dispenser 11 and/or second beverage dispenser 12. In various embodiments, first beverage dispenser 11 and/or second beverage dispenser 12 may further have an advertisement, logo, brand name, or design 36 located on first beverage dispenser 11 and/or second beverage dispenser 12.

First beverage dispenser 11 and second beverage dispenser 12 may further have lights. For example, in certain embodiments, first beverage dispenser 11 and/or second beverage dispenser 12 may have a light positioned adjacent to one or more dispensing heads 38, above one or more dispensing heads 38, below one or more dispensing heads 38, surrounding one or more dispensing heads 38, within one or more dispensing heads 38, or a combination thereof. Such lights are not limited to any particular kind of light.

In further embodiments, modular dispensing unit 1 may further comprise a motion detector that activates a first beverage dispenser light, such light positioned adjacent to one or more dispensing heads 38 of first beverage dispenser 11, above one or more dispensing heads 38 of first beverage dispenser 11, below one or more dispensing heads 38 of first beverage dispenser 11, surrounding one or more dispensing heads 38 of first beverage dispenser 11, or within one or more dispensing heads 38 of first beverage dispenser 11, based on the presence of a user in front of first beverage dispenser 11. In other embodiments, modular dispensing unit 1 may further comprise a gesture detector that activates a first beverage dispenser light, such light positioned adjacent to one or more dispensing heads 38 of first beverage dispenser 11, above one or more dispensing heads 38 of first beverage dispenser 11, below one or more dispensing heads 38 of first beverage dispenser 11, surrounding one or more dispensing heads 38 of first beverage dispenser 11, or within one or more dispensing heads 38 of first beverage dispenser 11, based on one or more gestures made by a user in front of first beverage dispenser 11.

In further embodiments, modular dispensing unit 1 may further comprise a motion detector that activates a second beverage dispenser light, such light positioned adjacent to one or more dispensing heads 38 of second beverage dispenser 12, above one or more dispensing heads 38 of second beverage dispenser 12, below one or more dispensing heads 38 of second beverage dispenser 12, surrounding one or more dispensing heads 38 of second beverage dispenser 12, or within one or more dispensing heads 38 of second beverage dispenser 12, based on the presence of a user in front of second beverage dispenser 12. In other embodiments, modular dispensing unit 1 may further comprise a gesture detector that activates a second beverage dispenser light, such light positioned adjacent to one or more dispensing heads 38 of second beverage dispenser 12, above one or more dispensing heads 38 of second beverage dispenser 12, below one or more dispensing heads 38 of second beverage dispenser 12, surrounding one or more dispensing heads 38 of second beverage dispenser 12, or within one or more dispensing heads 38 of second beverage dispenser 12, based on one or more gestures made by a user in front of second beverage dispenser 12.

First beverage dispenser 11 and second beverage dispenser 12 may utilize any suitable dispensing technology. For example, first beverage dispenser 11 and second beverage dispenser 12 may use traditional fountain drink mixing and/or dispensing equipment and methods. The mixing and/or transferring equipment may be located in storage area 17 or in a remote location. For example, the mixing and/or transferring equipment may be located in a room inside the venue.

In various embodiments, modular dispensing unit 1 may further have an advertisement, logo, brand name, or design 36 located on or adjacent to modular dispensing unit 1. For example, an advertisement, logo, brand name, or design 36 may be located on or adjacent to countertop 18, storage area 17, first beverage dispenser 11, second beverage dispenser 12, ice dispenser housing 14 or a combination thereof.

Figure 3:
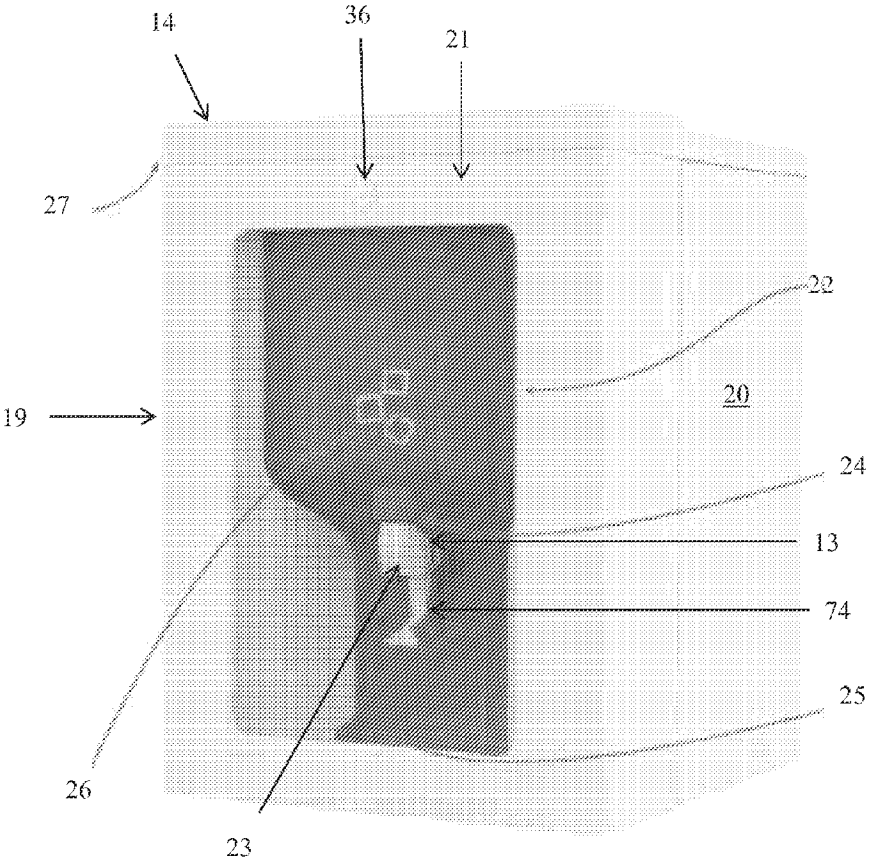
FIG. 3 illustrates an ice dispenser housing according to one or more embodiments.

FIG. 3 illustrates ice dispenser housing 14 according to certain embodiments. Ice dispenser housing 14 may have two housing sidewalls 19 and 20 and a front wall 21, with front wall 21 having an opening 22 that allows access to an ice outlet 23 of ice dispenser 13. Ice dispenser housing 14 may also have a lid 27, so that ice may be loaded into ice dispenser 13. An integrated bezel/nozzle cover 24 may at least partially cover ice outlet 23 of ice dispenser 13. Two housing sidewalls 19 and 20 and front wall 21 may run to the floor of drip tray 25 of ice dispenser 13. Ice dispenser housing 14 may further have a window 26 for a graphic treatment, advertisement, logo, brand name, or design 36. A lever 74, either existing from ice dispenser 13 or a part of ice dispenser housing 14, is accessible through opening 22.

In various embodiments, ice dispenser housing 14 may further have an advertisement, logo, brand name, or design 36 located on or adjacent to ice dispenser housing 14. For example, an advertisement, logo, brand name, or design 36 may be located on or adjacent to two housing sidewalls 19 or 20, lid 27, front wall 21 or a combination thereof.

Figure 4:
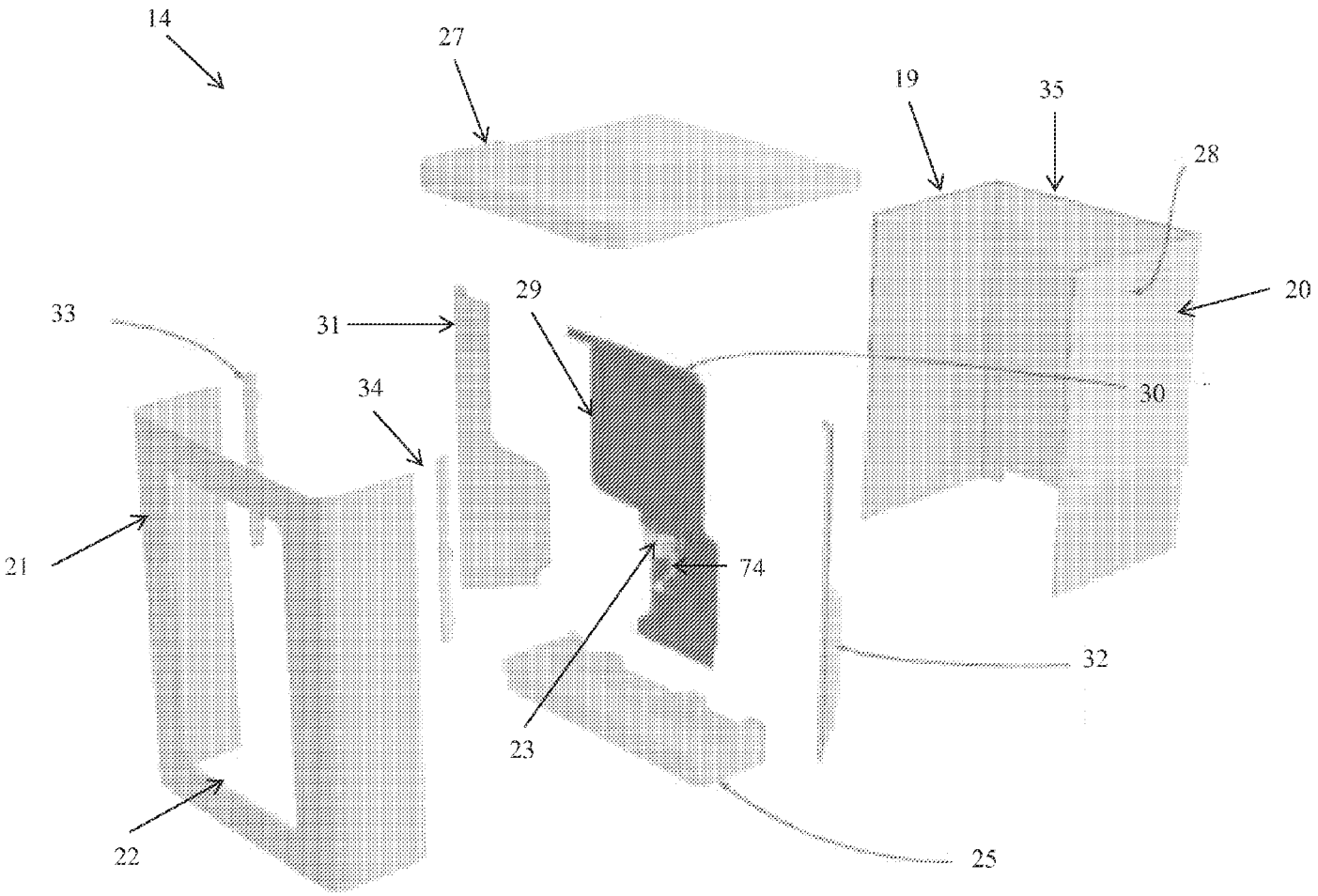
FIG. 4 illustrates an exploded view of an ice dispenser housing according to one or more embodiments.

FIG. 4 illustrates an exploded view of ice dispenser housing 14 according to one or more embodiments. Ice dispenser housing 14 may be of singular construction and have a back wrap 28 comprising a rear wall 35 and two housing sidewalls 19 and 20. A front wall 21 may have an opening 22. A lid 27 may be present so that ice may be loaded into ice dispenser 13 (not shown in FIG. 4, see FIGS. 1-3, 5, 6A and 12-14). A face plate 29 may at least partially cover a front surface of ice dispenser 13 (not shown in FIG.

4, see FIGS. 1-3, 5, 6A and 12-14) and be visible and accessible through opening 22. Face plate 29 may allow access to ice outlet 23 of ice dispenser 13 (not shown in FIG. 4, see FIGS. 1-3, 5, 6A and 12-14). A face plate tab 30 may attach to a backside of front wall 21. The existing drip tray 25 of ice dispenser 13 (not shown in FIG. 4, see FIGS. 1-3, 5, 6A and 12-14) may be accessible through opening 22. In other embodiments, ice dispenser housing 14 has a drip tray 25 that replaces or covers the existing drip tray 25 of ice dispenser 13 (not shown in FIG. 4, see FIGS. 1-3, 5, 6A and 12-14). Sidewall tabs 31 and 32 may attach to a backside of back wrap 28. Existing ice dispenser cleats 33 and 34 (i.e. steel cleats) may mount to an inner surface of front wall 21. A lever 74, either existing from ice dispenser 13 (not shown in FIG. 4, see FIGS. 1-3, 5, 6A and 12-14) or a part of ice dispenser housing 14, is accessible through opening 22.

Any suitable attachment mechanism may be used with face plate tab 30 and sidewall tabs 31 and 32. Suitable attachment mechanisms include, but are not limited to, glue, epoxy, adhesive, tape, screws, nails, nuts and bolts, key pins, tongue and groove construction, welding, molding or combinations thereof.

Figure 5:
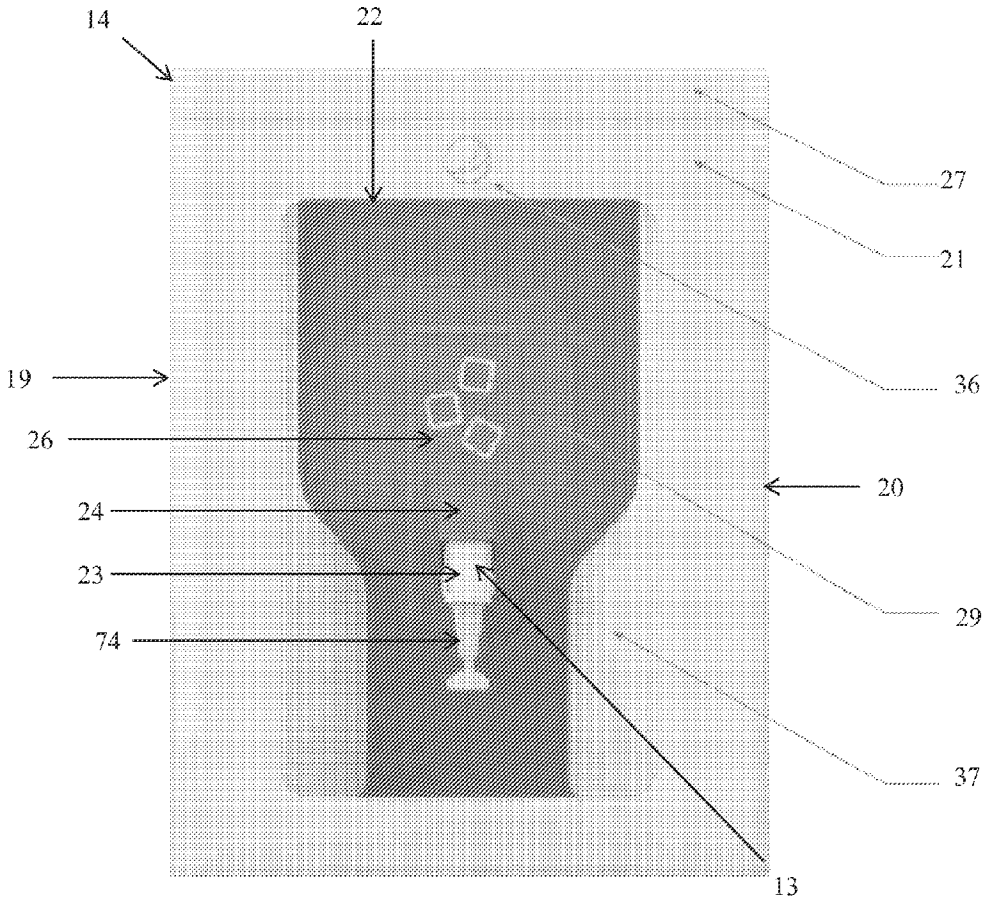
FIG. 5 illustrates an ice dispenser housing according to one or more embodiments.

FIG. 5 illustrates ice dispenser housing 14 according to certain embodiments. Ice dispenser housing 14 may have two housing sidewalls 19 and 20 and a front wall 21, with front wall 21 having an opening 22 that allows access to an ice outlet 23 of ice dispenser 13. Ice dispenser housing 14 may also have a lid 27, so that ice may be loaded into ice dispenser 13. An integrated bezel/nozzle cover 24 may at least partially cover ice outlet 23 of ice dispenser 13. Ice dispenser housing 14 may further have a window 26 for a graphic treatment, advertisement, logo, brand name, or design 36. A lever 74, either existing from ice dispenser 13 or a part of ice dispenser housing 14, is accessible through opening 22.

Two housing sidewalls 19 and 20 and front wall 21 may be of unitary construction, singular construction, or a combination thereof. In certain embodiments, lid 27, two housing sidewalls 19 and 20 and front wall 21 may be the same or similar color. In various embodiments, lid 27, two housing sidewalls 19 and 20 and front wall 21 are the same or similar color as a wall of the venue when modular dispensing unit 1 is installed in the venue. Front wall 21 may further comprise a logo, brand name, or design 36.

In certain embodiments, two housing sidewalls 19 and 20 and front wall 21 are made of the same material. For example, in some embodiments, two housing sidewalls 19 and 20 and front wall 21 are made of plastic. In other embodiments, two housing sidewalls 19 and 20 and front wall 21 are made of different materials. For example, in certain embodiments, two housing sidewalls 19 and 20 are made of stainless steel and front wall 21 is made of plastic. In some embodiments, two housing sidewalls 19 and 20 are made of painted stainless steel and front wall 21 is made of plastic.

In some embodiments, ice dispenser housing 14 may have a face plate 29 at least partially covering a front surface of ice dispenser 13 and visible and accessible through opening 22. In certain embodiments, face plate 29 may be the same or similar color as two housing sidewalls 19 and 20 and front wall 21. In other embodiments, face plate 29 may be a different color than two housing sidewalls 19 and 20 and front wall 21.

In certain embodiments, angled inner surface 37 of ice dispenser housing 14 may be the same or similar color as two housing sidewalls 19 and 20 and front wall 21. In other embodiments, angled inner surface 37 may be a different color than two housing sidewalls 19 and 20 and front wall 21. In some embodiments, angled inner surface 37 may be the same or similar color as face plate 29. In other embodiments, angled inner surface 37 may be a different color than face plate 29.

The existing drip tray 25 (not shown in FIG. 5, see FIGS. 3 and 4) of ice dispenser 13 may be accessible through opening 22. In other embodiments, ice dispenser housing 14 has a drip tray 25 (not shown in FIG. 5, see FIGS. 3 and 4) that replaces or covers the existing drip tray 25 (not shown in FIG. 5, see FIGS. 3 and 4) of ice dispenser 13. In some embodiments, drip tray 25 (not shown in FIG. 5, see FIGS. 3 and 4) may be the same or similar color as two housing sidewalls 19 and 20 and front wall 21. In other embodiments, drip tray 25 (not shown in FIG. 5, see FIGS. 3 and 4) may be a different color than two housing sidewalls 19 and 20 and front wall 21. In some embodiments, drip tray 25 (not shown in FIG. 5, see FIGS. 3 and 4) may be the same or similar color as face plate 29. In other embodiments, drip tray 25 (not shown in FIG. 5, see FIGS. 3 and 4) may be a different color than face plate 29.

Figures 6A, 6B:
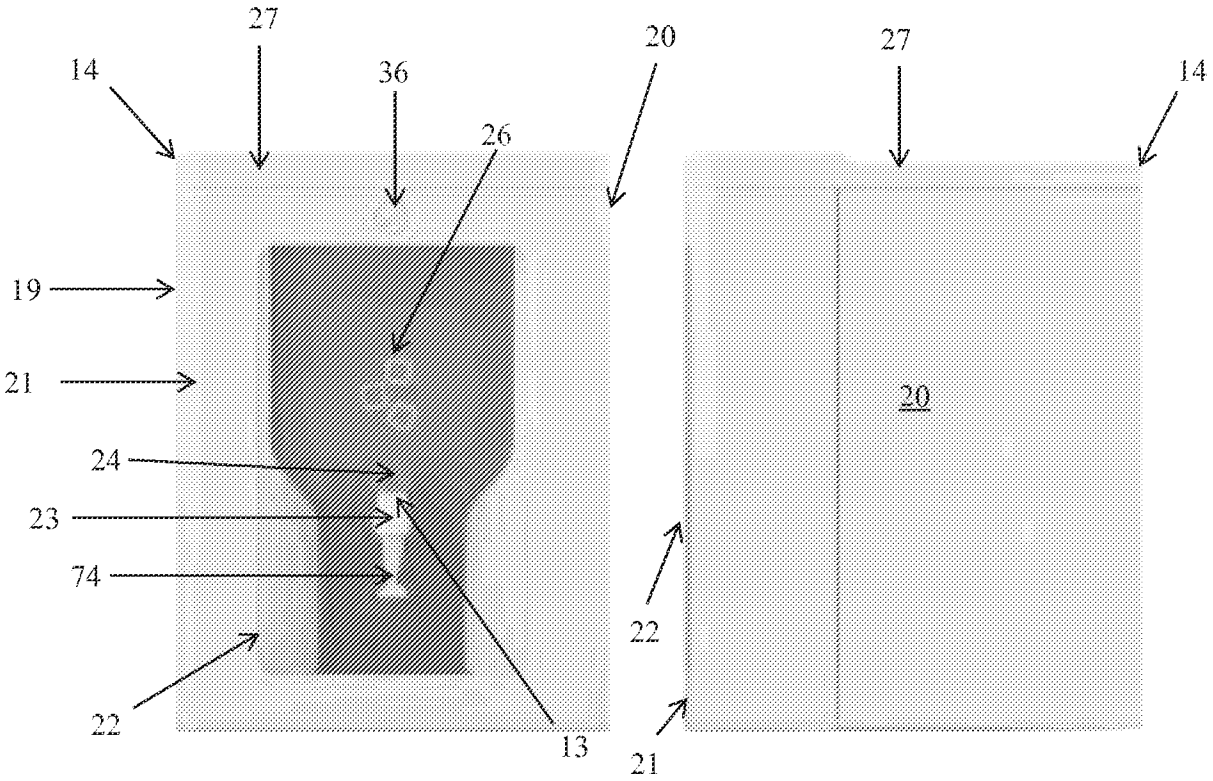
FIG. 6A illustrates a front view of an ice dispenser housing according to one or more embodiments.
FIG. 6B illustrates a side view of an ice dispenser housing according to one or more embodiments.

FIG. 6A illustrates a front view of ice dispenser housing 14 according to one or more embodiments. FIG. 6B illustrates a side view of ice dispenser housing 14 according to one or more embodiments. Ice dispenser housing 14 may have two housing sidewalls 19 and 20 and a front wall 21, with front wall 21 having an opening 22 that allows access to an ice outlet 23 of ice dispenser 13. Ice dispenser housing 14 may also have a lid 27, so that ice may be loaded into ice dispenser 13. An integrated bezel/nozzle cover 24 may at least partially cover ice outlet 23 of ice dispenser 13. Ice dispenser housing 14 may further have a window 26 for a graphic treatment, advertisement, logo, brand name, or design 36. A lever 74, either existing from ice dispenser 13 or a part of ice dispenser housing 14, is accessible through opening 22.

In various embodiments, ice dispenser housing 14 may further have an advertisement, logo, brand name, or design 36 located on or adjacent to ice dispenser housing 14. For example, an advertisement, logo, brand name, or design 36 may be located on or adjacent to two housing sidewalls 19 or 20, front wall 21 or a combination thereof.

In various embodiments, ice dispenser housing 14 does not attach to ice dispenser 13. For example, in some embodiments, ice dispenser housing 14 may fit over ice dispenser 13 like a sleeve or around ice dispenser 13 like a mask. In certain embodiments, two housing sidewalls 19 and 20 are attached to a wall of the venue when modular dispensing unit 1 is installed in the venue. In other embodiments, ice dispenser housing 14 may attach to ice dispenser 13 at one or more attachment/anchoring points.

Any suitable attachment mechanism may be used. Suitable attachment mechanisms include, but are not limited to, glue, epoxy, adhesive, tape, screws, nails, nuts and bolts, key pins, tongue and groove construction, welding, molding or combinations thereof.

Figures 7A, 7B:
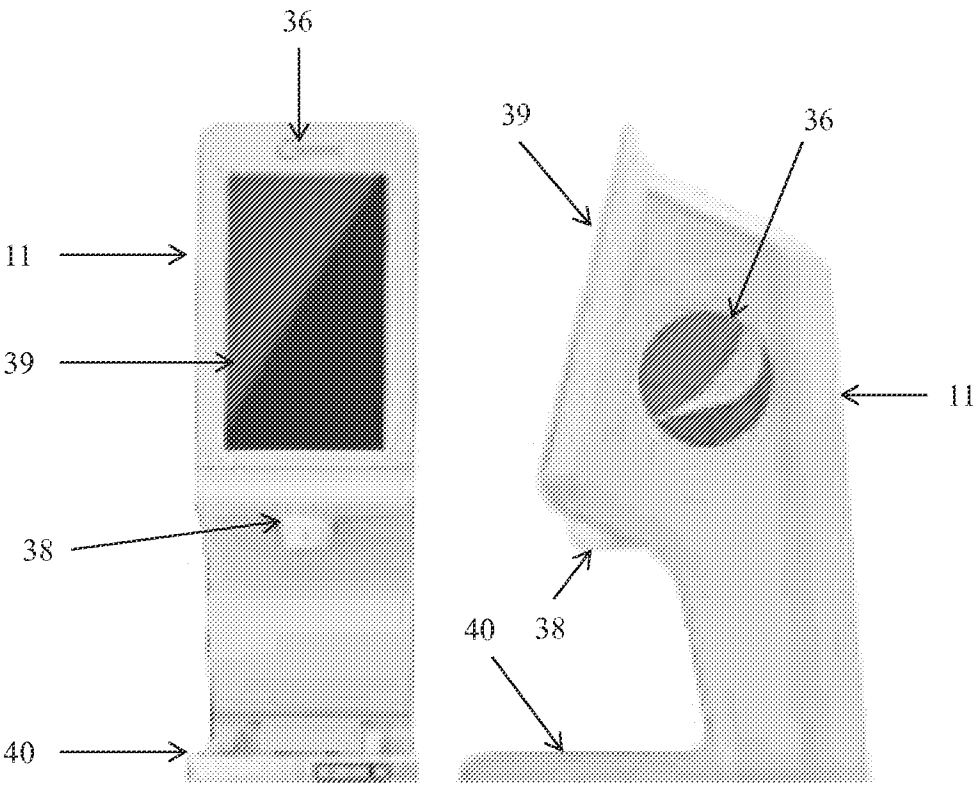
FIG. 7A illustrates a front view of a beverage dispenser according to one or more embodiments.
FIG. 7B illustrates a side view of a beverage dispenser according to one or more embodiments.

First beverage dispenser 11 and second beverage dispenser 12 are not limited to any particular type of beverage dispenser. FIGS. 1, 2, 7A, 7B, 12 and 14 show first beverage dispenser 11 and second beverage dispenser 12 according to one or more embodiments. FIG. 7A illustrates a front view of first beverage dispenser 11 according to one or more embodiments. FIG. 7B illustrates a side view of first beverage dispenser 11 according to one or more embodiments. In certain embodiments, first beverage dispenser 11 and second beverage dispenser 12 may comprise towers having one or more dispensing heads 38 from which one or more beverages may be dispensed. First beverage dispenser 11 and second beverage dispenser 12 may dispense hot or cold beverages. In various embodiments, first beverage dispenser 11 and second beverage dispenser 12 may dispense carbonated beverages, soft drinks, sodas, colas, juices, teas, water or combinations thereof.

In certain embodiments, first beverage dispenser 11 and/or second beverage dispenser 12 may have drip pan 40 positioned below one or more dispensing heads 38. In various embodiments, first beverage dispenser 11 and/or second beverage dispenser 12 may further comprise screen 39 where the consumer may view information about the available products and the particular beverage ordered by the consumer. In certain embodiments, screen 39 is a touchscreen that allows the consumer to interact with first beverage dispenser 11 and/or second beverage dispenser 12. In various embodiments, first beverage dispenser 11 and/or second beverage dispenser 12 may further have an advertisement, logo, brand name, or design 36 located on first beverage dispenser 11 and/or second beverage dispenser 12.

First beverage dispenser 11 and second beverage dispenser 12 may further have lights. For example, in certain embodiments, first beverage dispenser 11 and/or second beverage dispenser 12 may have a light positioned adjacent to one or more dispensing heads 38, above one or more dispensing heads 38, below one or more dispensing heads 38, surrounding one or more dispensing heads 38, within one or more dispensing heads 38, or a combination thereof. Such lights are not limited to any particular kind of light.

In further embodiments, modular dispensing unit 1 may further comprise a motion detector that activates a first beverage dispenser light, such light positioned adjacent to one or more dispensing heads 38 of first beverage dispenser 11, above one or more dispensing heads 38 of first beverage dispenser 11, below one or more dispensing heads 38 of first beverage dispenser 11, surrounding one or more dispensing heads 38 of first beverage dispenser 11, or within one or more dispensing heads 38 of first beverage dispenser 11, based on the presence of a user in front of first beverage dispenser 11. In other embodiments, modular dispensing unit 1 may further comprise a gesture detector that activates a first beverage dispenser light, such light positioned adjacent to one or more dispensing heads 38 of first beverage dispenser 11, above one or more dispensing heads 38 of first beverage dispenser 11, below one or more dispensing heads 38 of first beverage dispenser 11, surrounding one or more dispensing heads 38 of first beverage dispenser 11, or within one or more dispensing heads 38 of first beverage dispenser 11, based on one or more gestures made by a user in front of first beverage dispenser 11.

In further embodiments, modular dispensing unit 1 may further comprise a motion detector that activates a second beverage dispenser light, such light positioned adjacent to one or more dispensing heads 38 of second beverage dispenser 12, above one or more dispensing heads 38 of second beverage dispenser 12, below one or more dispensing heads 38 of second beverage dispenser 12, surrounding one or more dispensing heads 38 of second beverage dispenser 12, or within one or more dispensing heads 38 of second beverage dispenser 12, based on the presence of a user in front of second beverage dispenser 12. In other embodiments, modular dispensing unit 1 may further comprise a gesture detector that activates a second beverage dispenser light, such light positioned adjacent to one or more dispensing heads 38 of second beverage dispenser 12, above one or more dispensing heads 38 of second beverage dispenser 12, below one or more dispensing heads 38 of second beverage dispenser 12, surrounding one or more dispensing heads 38 of second beverage dispenser 12, or within one or more dispensing heads 38 of second beverage dispenser 12, based on one or more gestures made by a user in front of second beverage dispenser 12.

First beverage dispenser 11 and second beverage dispenser 12 may utilize any suitable dispensing technology. For example, first beverage dispenser 11 and second beverage dispenser 12 may use traditional fountain drink mixing and/or dispensing equipment and methods. The mixing and/or transferring equipment may be located in storage area 17 or in a remote location. For example, the mixing and/or transferring equipment may be located in a room inside the venue.

Figure 8:
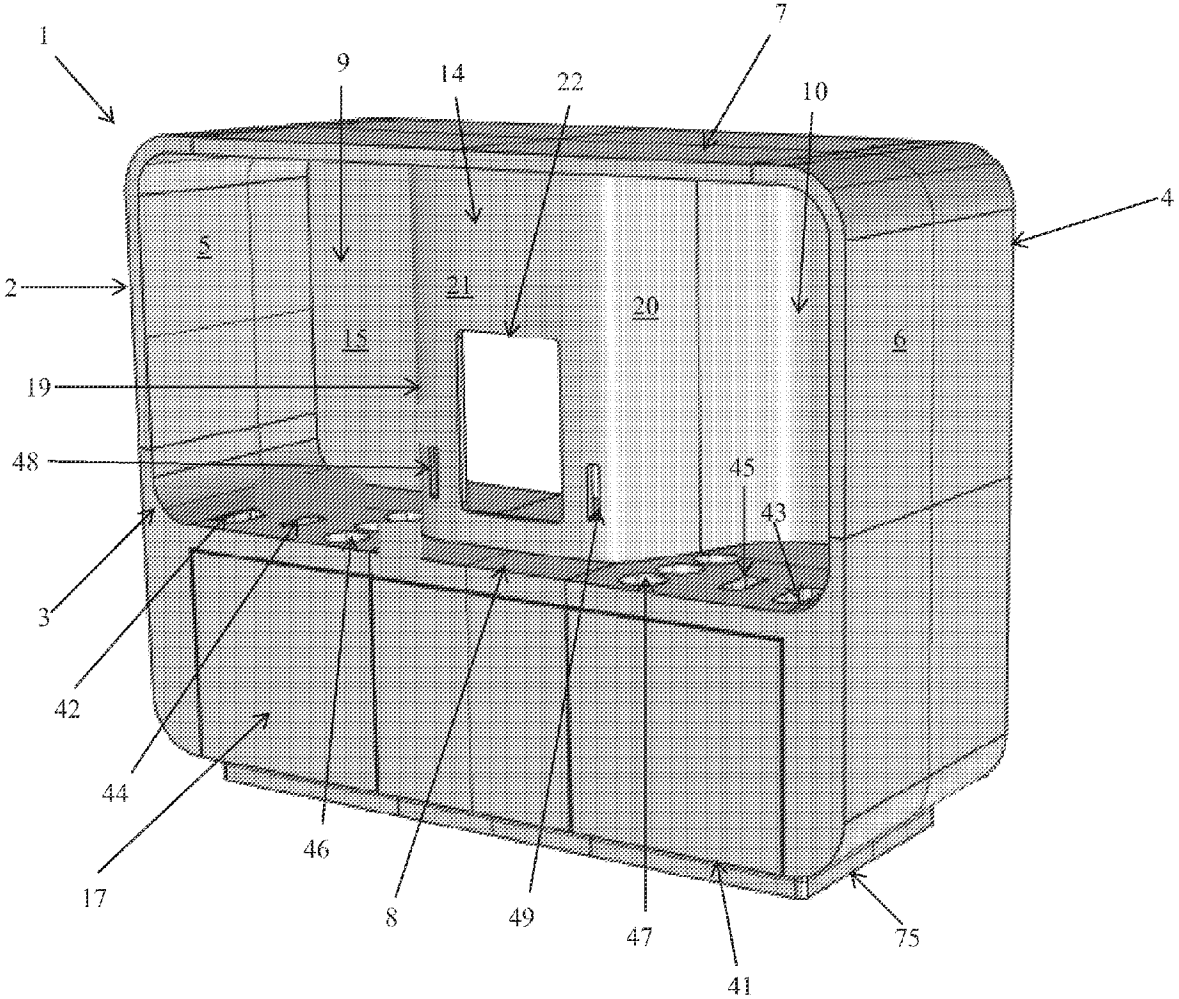
FIG. 8 illustrates a modular dispensing unit according to one or more embodiments.

FIG. 8 illustrates modular dispensing unit 1, before first beverage dispenser 11 (not shown in FIG. 8, see FIGS. 1, 12 and 14), second beverage dispenser 12 (not shown in FIG. 8, see FIGS. 1, 12 and 14) and ice dispenser 13 (not shown in FIG. 8, see FIGS. 1-3, 5, 6A and 12-14) have been positioned in modular dispensing unit 1, according to one or more embodiments. Modular dispensing unit 1 has a frame 2 having a front side 3, back side 4, two sidewalls 5 and 6, a top wall 7, an intermediate wall 8 and a bottom wall 41. A first enclave 9 and a second enclave 10 are situated within frame 2. An ice dispenser housing 14 is positioned between first enclave 9 and second enclave 10. After constructing and assembling modular dispensing unit 1, an ice dispenser 13 (not shown in FIG. 8, see FIGS. 1-3, 5, 6A and 12-14) may be positioned within ice dispenser housing 14 between first enclave 9 and second enclave 10, so that ice dispenser housing 14 surrounds substantially the entire ice dispenser 13 (not shown in FIG. 8, see FIGS. 1-3, 5, 6A and 12-14). Ice dispenser housing 14 may have two housing sidewalls 19 and 20 and a front wall 21, with front wall 21 having an opening 22 that allows access to ice dispenser 13 (not shown in FIG. 8, see FIGS. 1-3, 5, 6A and 12-14).

In various embodiments, intermediate wall 8 may have a first trash receptacle opening 42 and second trash receptacle opening 43. In certain embodiments, first trash receptacle opening 42 is positioned adjacent to first beverage dispenser 11 (not shown in FIG. 8, see FIGS. 1, 12 and 14) and second trash receptacle opening 43 is positioned adjacent to second beverage dispenser 12 (not shown in FIG. 8, see FIGS. 1, 12 and 14), allowing users of both first beverage dispenser 11 (not shown in FIG. 8, see FIGS. 1, 12 and 14) and second beverage dispenser 12 (not shown in FIG. 8, see FIGS. 1, 12 and 14) to easily and quickly dispose of trash, focus on the available products, and avoid interfering with the experience of other users.

Intermediate wall 8 may have a first beverage dispenser opening 44 over which first beverage dispenser 11 (not shown in FIG. 8, see FIGS. 1, 12 and 14) may be positioned. Beverage dispensing equipment, mixing equipment, transferring equipment, electrical cords, tubing, piping, and combinations thereof, for example, may run from first beverage dispenser 11 (not shown in FIG. 8, see FIGS. 1, 12 and 14) through first beverage dispenser opening 44 to a location underneath intermediate wall 8 (i.e. storage area 17), a location immediately outside modular dispensing unit 1, a remote location (i.e. a room inside the venue) or a combination thereof.

Intermediate wall 8 may have a second beverage dispenser opening 45 over which second beverage dispenser 12 (not shown in FIG. 8, see FIGS. 1, 12 and 14) may be positioned. Beverage dispensing equipment, mixing equipment, transferring equipment, electrical cords, tubing, piping, and combinations thereof, for example, may run from second beverage dispenser 12 (not shown in FIG. 8, see FIGS. 1, 12 and 14) through second beverage dispenser opening 45 to a location underneath intermediate wall 8 (i.e. storage area 17), a location immediately outside modular dispensing unit 1, a remote location (i.e. a room inside the venue) or a combination thereof.

Intermediate wall 8 may comprise first recessed pocket(s) or container(s) 46 and second recessed pocket(s) or container(s) 47. First recessed pocket(s) or container(s) 46 and second recessed pocket(s) or container(s) 47 may be used, for example, to store and/or dispense straws, lids or cups below an upper surface of intermediate wall 8. First recessed pocket(s) or container(s) 46 and second recessed pocket(s) or container(s) 47 reduce clutter and further focus consumer attention on the available products. In certain embodiments, first recessed pocket(s) or container(s) 46 are positioned adjacent to first beverage dispenser 11 (not shown in FIG. 8, see FIGS. 1, 12 and 14) and second recessed pocket(s) or container(s) 47 are positioned adjacent to second beverage dispenser 12 (not shown in FIG. 8, see FIGS. 1, 12 and 14), allowing users of both first beverage dispenser 11 (not shown in FIG. 8, see FIGS. 1, 12 and 14) and second beverage dispenser 12 (not shown in FIG. 8, see FIGS. 1, 12 and 14) to easily and quickly access straws, lids, cups or combinations thereof, focus on the available products, and avoid interfering with the experience of other users.

In certain embodiments, ice dispenser housing 14 may have a first napkin dispenser opening 48 and second napkin dispenser opening 49. In some embodiments, first napkin dispenser opening 48 is positioned adjacent to first beverage dispenser 11 (not shown in FIG. 8, see FIGS. 1, 12 and 14) and second napkin dispenser opening 49 is positioned adjacent to second beverage dispenser 12 (not shown in FIG. 8, see FIGS. 1, 12 and 14), allowing users of both first beverage dispenser 11 (not shown in FIG. 8, see FIGS. 1, 12 and 14) and second beverage dispenser 12 (not shown in FIG. 8, see FIGS. 1, 12 and 14) to easily and quickly access napkins, focus on the available products, and avoid interfering with the experience of other users. Napkin dispensers (not shown) may be located inside ice dispenser housing 14 adjacent first napkin dispenser opening 48 and second napkin dispenser opening 49.

Frame 2, including front side 3, back side 4, two sidewalls 5 and 6, top wall 7, intermediate wall 8 and bottom wall 41, and ice dispenser housing 14 may be constructed of any suitable materials. Exemplary materials include, but are not limited to, stainless steel, aluminum, plastic, wood and combinations thereof. In some embodiments, the entire frame 2 and/or ice dispenser housing 14 may be made from plastic. In other embodiments, the entire frame 2 and/or ice dispenser housing 14 may be made from stainless steel. In further embodiments, the entire frame 2 and/or ice dispenser housing 14 may be made from aluminum. In yet other embodiments, intermediate wall 8 is stainless steel and the remainder of frame 2 and/or ice dispenser housing 14 is plastic. In still further embodiments, intermediate wall 8 is aluminum and the remainder of frame 2 and/or ice dispenser housing 14 is plastic. In certain embodiments, frame 2 and/or ice dispenser housing 14 may be made from stainless steel, aluminum and plastic.

Bottom wall 41, intermediate wall 8, two sidewalls 5 and 6, top wall 7 and ice dispenser housing 14 of modular dispensing unit 1 may be of unitary construction, singular construction, or a combination thereof. In certain embodiments, bottom wall 41, intermediate wall 8, two sidewalls 5 and 6 and top wall 7 of modular dispensing unit 1 are of unitary construction. In further embodiments, bottom wall 41, intermediate wall 8, two sidewalls 5 and 6, top wall 7 and ice dispenser housing 14 of modular dispensing unit 1 are of unitary construction. In some embodiments, intermediate wall 8, two sidewalls 5 and 6 and top wall 7 of modular dispensing unit 1 are of unitary construction. In other embodiments, bottom wall 41, intermediate wall 8, two sidewalls 5 and 6, top wall 7 and ice dispenser housing 14 of modular dispensing unit 1 are of singular construction. In further embodiments, some of frame 2 components may be of unitary construction while other components are of singular construction. For example, intermediate wall 8 and two sidewalls 5 and 6 of modular dispensing unit 1 may be of unitary construction, while top wall 7 is of singular construction. In other embodiments, top wall 7 and two sidewalls 5 and 6 of modular dispensing unit 1 may be of unitary construction, while intermediate wall 8 is of singular construction. In certain embodiments, intermediate wall 8, two sidewalls 5 and 6, top wall 7 and ice dispenser housing 14 are of unitary construction. In various embodiments, ice dispenser housing 14 is a prefabricated unit that may be installed in a frame 2 comprising an intermediate wall 8, two sidewalls 5 and 6 and top wall 7 of unitary construction. In other embodiments, ice dispenser housing 14 is a prefabricated unit that may be installed in a frame 2 comprising an intermediate wall 8, two sidewalls 5 and 6 and top wall 7 of singular construction.

In certain embodiments, modular dispensing unit 1 has a storage area 17 located underneath intermediate wall 8. Storage area 17 is not particularly limited. For example, storage area 17 may comprise cabinets, shelves or a combination thereof. Storage area 17 may be used to house beverage supplies (i.e. straws, lids, cups, etc.), beverage ingredients, carbon dioxide, ice dispenser equipment, beverage dispenser equipment, cooling equipment, trash or combinations thereof.

In various embodiments, back side 4 comprises a back wall 15. Back wall 15, bottom wall 41, storage area 17, intermediate wall 8, two sidewalls 5 and 6, top wall 7 and ice dispenser housing 14 of modular dispensing unit 1 may be of unitary construction, singular construction, or a combination thereof. In certain embodiments, the various individual components of modular dispensing unit 1 (i.e. back wall 15, bottom wall 41, intermediate wall 8, two sidewalls 5 and 6, top wall 7, storage area 17 and ice dispenser housing 14) may be made-up of sub-components. For example, in some embodiments, top wall 7 may comprise two or more sub-top wall components. In other embodiments, back wall 15 may comprise two or more sub-back wall components. In further embodiments, bottom wall 41 may comprise two or more sub-bottom wall components. In certain embodiments, intermediate wall 8 may comprise two or more sub-intermediate wall components. In other embodiments, two sidewalls 5 and 6 may comprise two or more sub-sidewall components. In further embodiments, storage area 17 may comprise two or more sub-storage area components. In still other embodiments, ice dispenser housing 14 may comprise two or more sub-ice dispenser housing components.

In one or more embodiments, bottom wall 41, storage area 17, back wall 15, intermediate wall 8, two sidewalls 5 and 6 and top wall 7 of modular dispensing unit 1 are of unitary construction. In certain embodiments, back wall 15, intermediate wall 8, two sidewalls 5 and 6 and top wall 7 of modular dispensing unit 1 are of unitary construction. In other embodiments, bottom wall 41, storage area 17, back wall 15, intermediate wall 8, two sidewalls 5 and 6 and top wall 7 of modular dispensing unit 1 are of singular construction. In further embodiments, some of frame 2 components may be of unitary construction while other components are of singular construction. For example, back wall 15, intermediate wall 8 and two sidewalls 5 and 6 of modular dispensing unit 1 may be of unitary construction, while top wall 7 is of singular construction. In other embodiments, back wall 15, top wall 7 and two sidewalls 5 and 6 of modular dispensing unit 1 may be of unitary construction, while intermediate wall 8 is of singular construction. In further embodiments, intermediate wall 8, two sidewalls 5 and 6 and top wall 7 of modular dispensing unit 1 are of unitary construction, while back wall 15 is of singular construction. In still further embodiments, back wall 15, intermediate wall 8 and top wall 7 are of unitary construction, while two sidewalls 5 and 6 are of singular construction.

Figure 12:
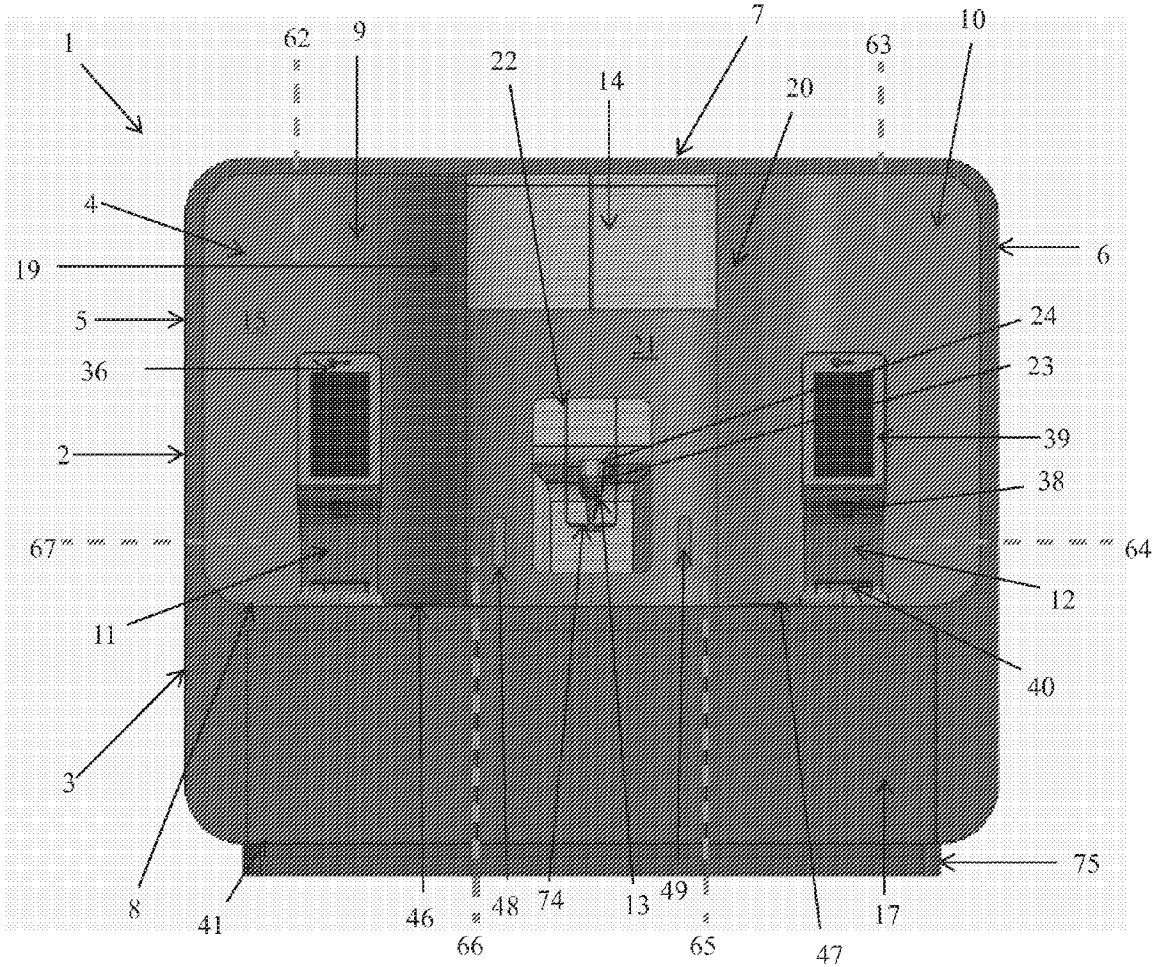
FIG. 12 illustrates a modular dispensing unit according to one or more embodiments.
Figure 14:
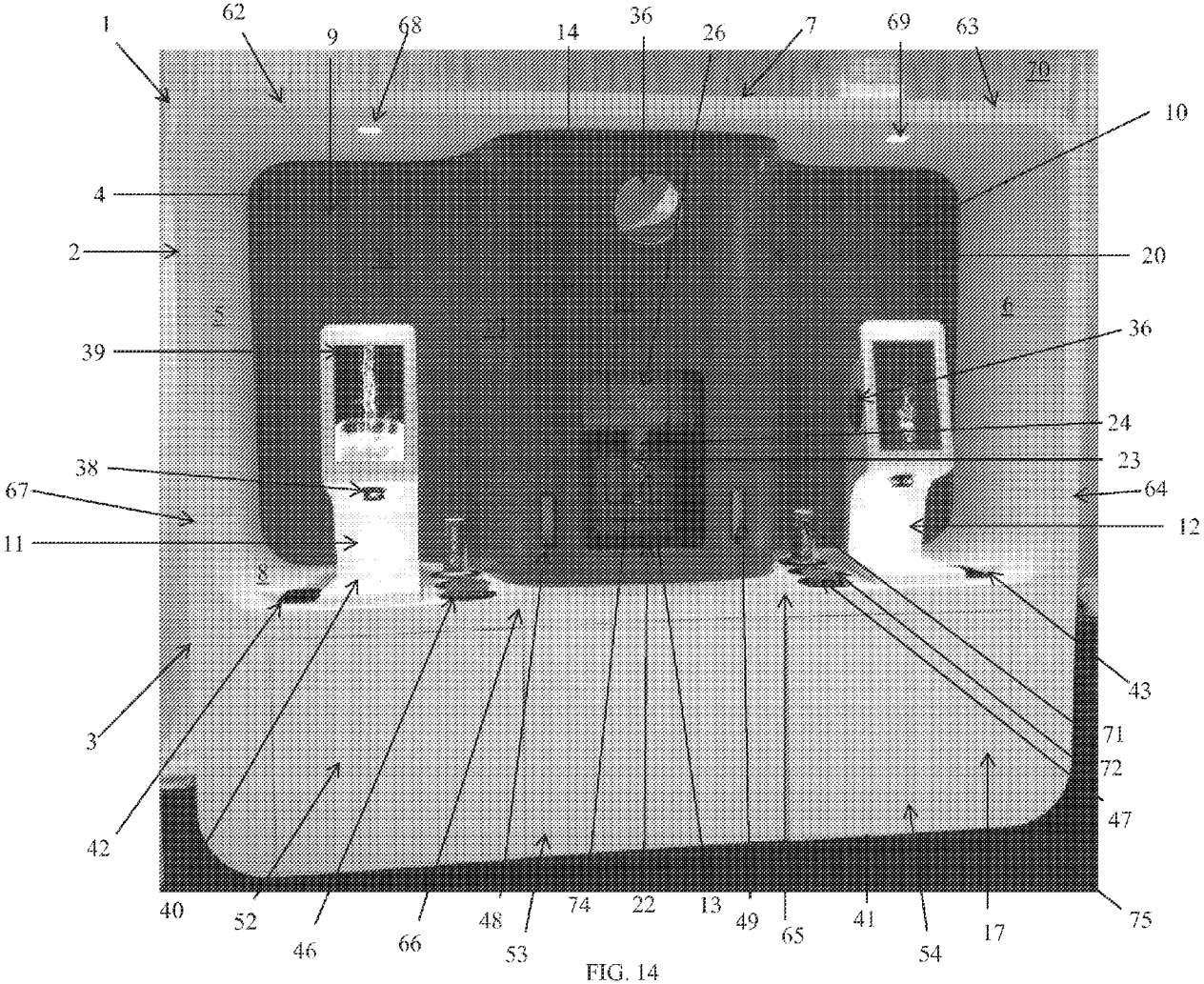
FIG. 14 illustrates a modular dispensing unit according to one or more embodiments.

In some embodiments, top wall 7 may further comprise a first spotlight 68 (not shown in FIG. 8, see FIG. 14) located above first beverage dispenser 11 (not shown in FIG. 8, see FIGS. 1, 12 and 14) and a second spotlight 69 (not shown in FIG. 8, see FIG. 14) located above second beverage dispenser 12 (not shown in FIG. 8, see FIGS. 1, 12 and 14). In certain embodiments, first spotlight 68 (not shown in FIG. 8, see FIG. 14) and second spotlight 69 (not shown in FIG. 8, see FIG. 14) are recessed in top wall 7. First spotlight 68 (not shown in FIG. 8, see FIG. 14) and second spotlight 69 (not shown in FIG. 8, see FIG. 14) are not limited to any particular kind of light.

In further embodiments, modular dispensing unit 1 may further comprise a motion detector that activates first spotlight 68 (not shown in FIG. 8, see FIG. 14) above first beverage dispenser 11 (not shown in FIG. 8, see FIGS. 1, 12 and 14) based on the presence of a user in front of first beverage dispenser 11 (not shown in FIG. 8, see FIGS. 1, 12 and 14). In other embodiments, modular dispensing unit 1 may further comprise a gesture detector that activates first spotlight 68 (not shown in FIG. 8, see FIG. 14) above first beverage dispenser 11 (not shown in FIG. 8, see FIGS. 1, 12 and 14) based on one or more gestures made by a user in front of first beverage dispenser 11 (not shown in FIG. 8, see FIGS. 1, 12 and 14).

In some embodiments, modular dispensing unit 1 may further comprise a motion detector that activates second spotlight 69 (not shown in FIG. 8, see FIG. 14) above second beverage dispenser 12 (not shown in FIG. 8, see FIGS. 1, 12 and 14) based on the presence of a user in front of second beverage dispenser 12 (not shown in FIG. 8, see FIGS. 1, 12 and 14). In other embodiments, modular dispensing unit 1 may further comprise a gesture detector that activates second spotlight 69 (not shown in FIG. 8, see FIG. 14) above second beverage dispenser 12 (not shown in FIG. 8, see FIGS. 1, 12 and 14) based on one or more gestures made by a user in front of second beverage dispenser 12 (not shown in FIG. 8, see FIGS. 1, 12 and 14).

In certain embodiments, modular dispensing unit 1 may further comprise a front panel 16 (not shown in FIG. 8, see FIG. 1) attached or connected to front side 3 via top wall 7 and/or sidewalls 5 and/or 6. Intermediate wall 8, two sidewalls 5 and 6, top wall 7 and front panel 16 (not shown in FIG. 8, see FIG. 1) of modular dispensing unit 1 may be of unitary construction, singular construction, or a combination thereof.

In various embodiments, modular dispensing unit 1 may further have an advertisement, logo, brand name, or design 36 (not shown in FIG. 8, see FIGS. 2, 3, 5, 6A, 7A, 7B, 13 and 14) located on or adjacent to modular dispensing unit 1. For example, an advertisement, logo, brand name, or design 36 (not shown in FIG. 8, see FIGS. 2, 3, 5, 6A, 7A, 7B, 13 and 14) may be located on or adjacent to bottom wall 41, front side 3, back side 4, back wall 15, sidewalls 5 and/or 6, top wall 7, intermediate wall 8, front panel 16 (not shown in FIG. 8, see FIG. 1), storage area 17, ice dispenser housing 14 or a combination thereof.

Base 75 may be positioned underneath bottom wall 41. In various embodiments, base 75 and bottom wall 41 may be of unitary construction or singular construction. In some embodiments base 75 is attached to bottom wall 41. In other embodiments, base 75 and bottom wall 41 are of unitary construction. In certain embodiments, base 75 may be attached to the floor of the venue. Examples of base 75 include, but are not limited to, a platform, wheels, casters, legs, pegs, blocks, or a combination thereof.

In various embodiments, ice dispenser housing 14 is not attached to ice dispenser 13 (not shown in FIG. 8, see FIGS. 1-3, 5, 6A and 12-14). In certain embodiments, ice dispenser housing 14 is attached to back side 4, back wall 15, intermediate wall 8, two sidewalls 5 and/or 6, top wall 7, or a combination thereof. In some embodiments, ice dispenser housing 14 is attached to back side 4. In other embodiments, ice dispenser housing 14 is attached to back wall 15. In further embodiments, ice dispenser housing 14 is attached to intermediate wall 8. In still other embodiments, ice dispenser housing 14 is attached to two sidewalls 5 and 6. In still further embodiments, ice dispenser housing 14 is attached to top wall 7. In other embodiments, ice dispenser housing 14 is attached to a wall of the venue when modular dispensing unit 1 is installed in the venue.

Any suitable attachment mechanism may be used. Suitable attachment mechanisms include, but are not limited to, glue, epoxy, adhesive, tape, screws, nails, nuts and bolts, key pins, tongue and groove construction, welding, molding or combinations thereof.

In order to minimize the appearance of ice dispenser 13 (not shown in FIG. 8, see FIGS. 1-3, 5, 6A and 12-14) and frame the consumer experience, ice dispenser housing 14 may be the same or similar color as a wall of the venue when modular dispensing unit 1 is installed in the venue. Matching the color of ice dispenser housing 14 to a wall of the venue allows ice dispenser 13 (not shown in FIG. 8, see FIGS. 1-3, 5, 6A and 12-14) to essentially blend in with the wall of the venue. When ice dispenser housing 14 blends in with the wall of the venue, the consumer then focuses on the available products and branding information. A cohesive beverage dispensing experience is created and the size (i.e. the width, depth and height) of ice dispenser 13 (not shown in FIG. 8, see FIGS. 1-3, 5, 6A and 12-14) is hidden without any loss of functionality. Further, when a frame 2 is present and ice dispenser housing 14 is the same or similar color as the wall of the venue, the consumer is less likely to be distracted by the chaos of the venue and equipment. In essence, the user experience becomes framed and the consumer is more able to focus on the available products.

In some embodiments, ice dispenser housing 14 is the same or similar color as a covering positioned on or adjacent to the wall of the venue when modular dispensing unit 1 is installed in the venue. Such covering is not particularly limited. The covering may be, for example, made of paint, cloth/fabric, paper, plastic, metal, cardboard, paperboard or a combination thereof.

In certain embodiments, back side 4 comprises a back wall 15, and back wall 15 is the same or similar color as a wall of the venue when the modular dispensing unit is installed in the venue. In further embodiments, ice dispenser housing 14 and back wall 15 are the same or similar color as a wall of the venue when modular dispensing unit 1 is installed in the venue. In certain embodiments, ice dispenser housing 14 and back wall 15 are of unitary construction and are the same or similar color as a wall of the venue when modular dispensing unit 1 is installed in the venue.

In one or more embodiments, ice dispenser housing 14 and back wall 15 are the same or similar color as a covering positioned on or adjacent to the wall of the venue when modular dispensing unit 1 is installed in the venue. Such covering is not particularly limited. The covering may be, for example, made of paint, cloth/fabric, paper, plastic, metal, cardboard, paperboard or a combination thereof.

In some embodiments, frame 2 of modular dispensing unit 1, including front side 3, back side 4, two sidewalls 5 and 6, top wall 7, intermediate wall 8, storage area 17 and bottom wall 41, is the same or similar color as a wall of the venue when modular dispensing unit 1 is installed in the venue. The wall of the venue is not particularly limited. In various embodiments, the wall of the venue may be, for example, made of cloth/fabric, wood, drywall, concrete, bricks, metal, stone or a combination thereof.

In certain embodiments, frame 2 of modular dispensing unit 1, including front side 3, back side 4, two sidewalls 5 and 6, top wall 7, intermediate wall 8, storage area 17 and bottom wall 41, is the same or similar color as a covering positioned on or adjacent to the wall of the venue when modular dispensing unit 1 is installed in the venue. Such covering is not particularly limited. The covering may be, for example, made of paint, cloth/fabric, paper, plastic, metal, cardboard, paperboard or a combination thereof.

Modular dispensing unit 1 may be constructed and/or assembled off-site and then transported to an intended venue, constructed and/or assembled on-site, or a combination thereof. For example, in some embodiments, the entire modular dispensing unit 1 may be constructed and/or assembled off-site and then transported to the intended venue. In other embodiments, the entire modular dispensing unit 1 may be constructed and/or assembled on-site at the intended venue. In yet other embodiments, components of modular dispensing unit 1 (i.e. frame 2) may be constructed off-site, transported to the intended venue and then assembled with the remaining modular dispensing unit 1 components.

Exemplary venues include, but are not limited to, restaurants, gas stations, convenience stores, theaters, convention centers, shopping malls, sporting arenas and stadiums, airports, cafeterias and other entertainment and/or food service sites. In various embodiments, modular dispensing unit 1 may be installed on a wall of a venue, against a wall of a venue, adjacent to a wall of a venue, embedded in a wall of a venue or a combination thereof. In certain embodiments, frame 2 may define a wall of the venue. In other embodiments, frame 2 and a wall of the venue are of unitary construction. In some embodiments, upon installation, frame 2 becomes one with a wall of the venue.

In various embodiments, modular dispensing unit 1 is sized so that it may be easily transported and installed in the intended venue. For example, in some embodiments, modular dispensing unit 1 is sized so that a fully constructed and/or assembled unit may fit in an elevator.

Placing ice dispenser 13 (not shown in FIG. 8, see FIGS. 1-3, 5, 6A and 12-14) surrounded by ice dispenser housing 14 between first beverage dispenser 11 (not shown in FIG. 8, see FIGS. 1, 12 and 14) and second beverage dispenser 12 (not shown in FIG. 8, see FIGS. 1, 12 and 14) allows for a semi-private user experience and further focuses consumer attention on the available products. In certain embodiments, two housing sidewalls 19 and 20 are attached to a wall of the venue when modular dispensing unit 1 is installed in the venue. In some embodiments, two housing sidewalls 19 and 20 are attached to back wall 15. In further embodiments, two housing sidewalls 19 and 20 and back wall 15 are of unitary construction.

Figure 9:
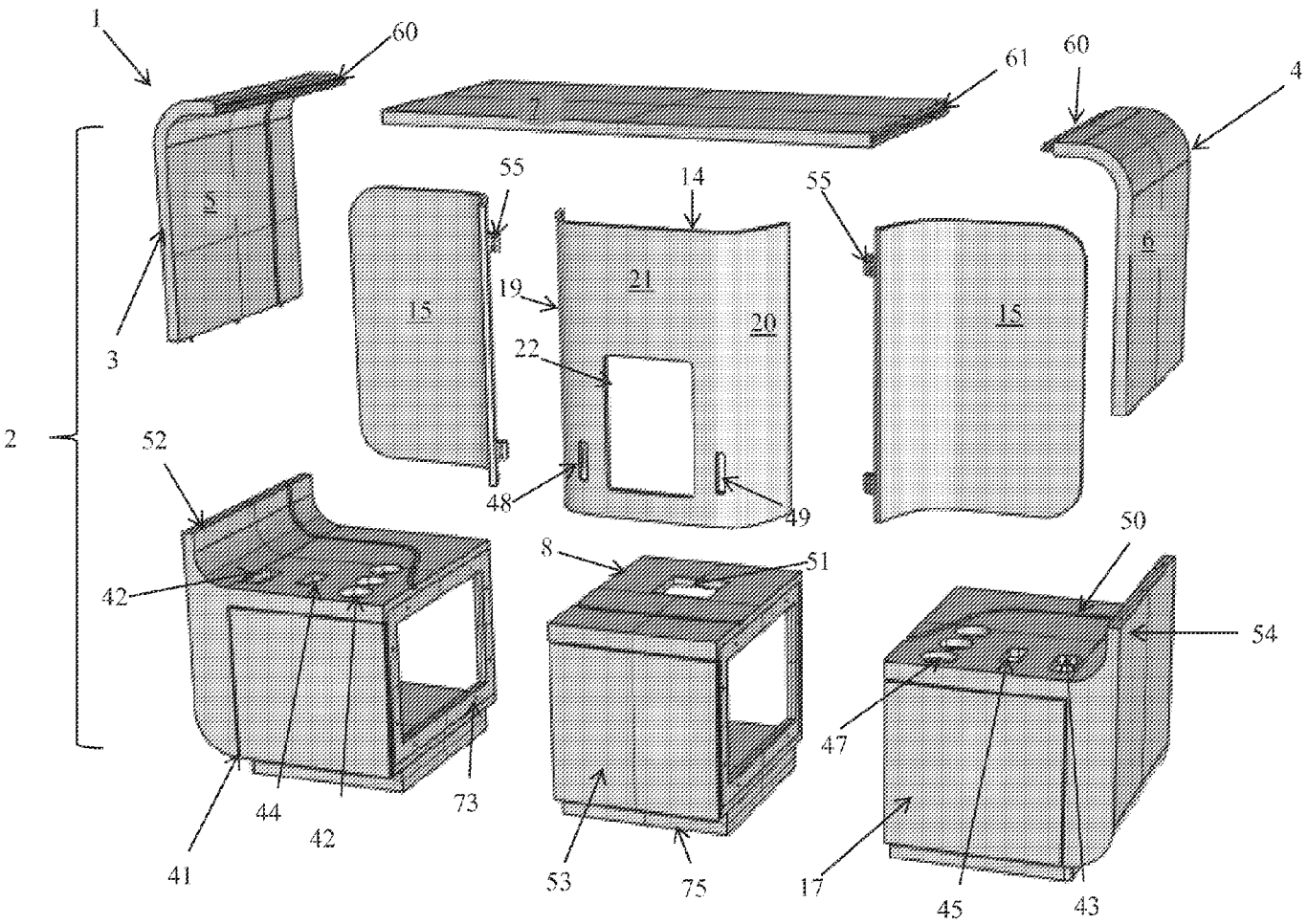
FIG. 9 illustrates an exploded view of a modular dispensing unit according to one or more embodiments.
Figures 10A, 10B, 10C, 10D:
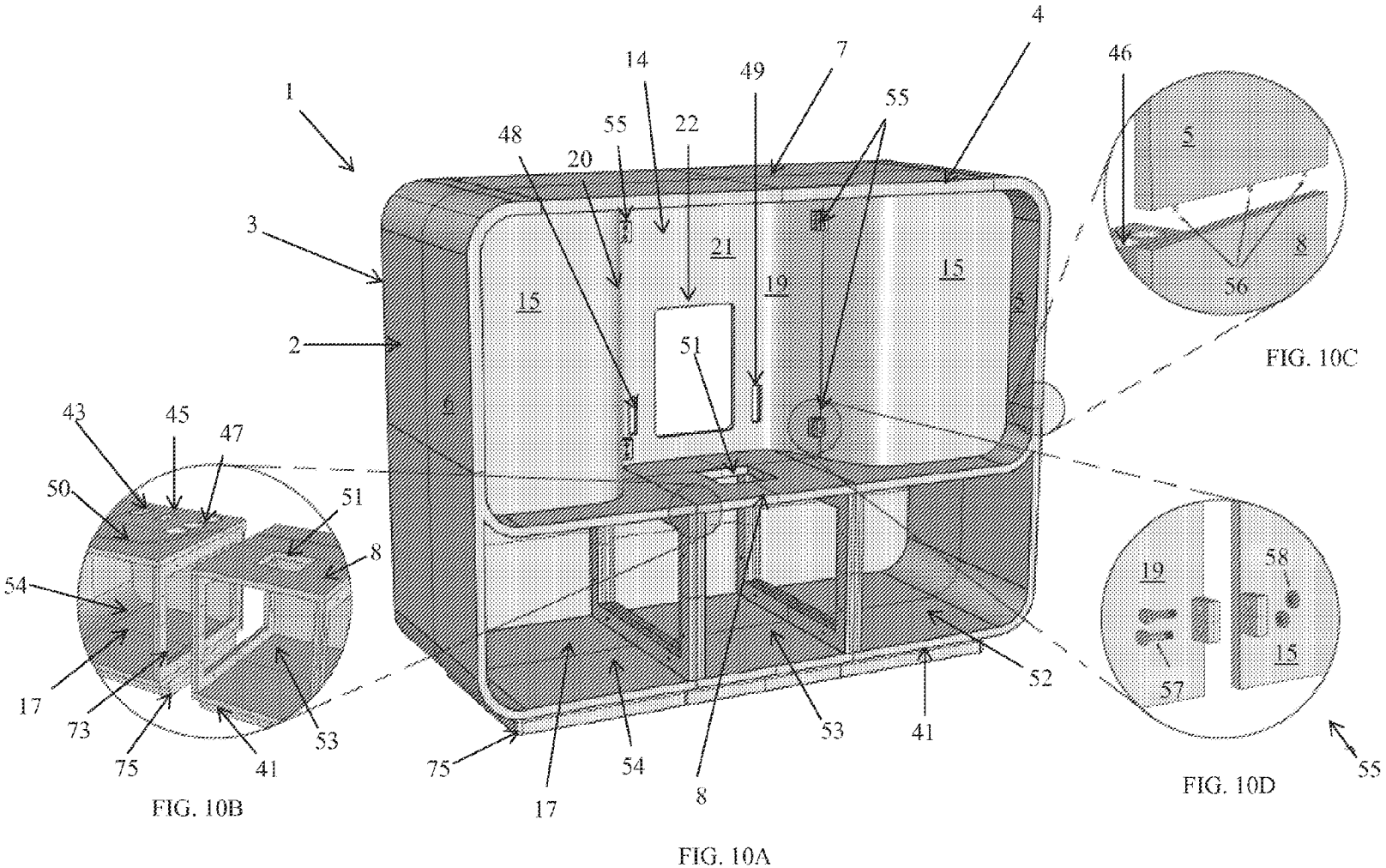
FIG. 10A illustrates a rear view of a modular dispensing unit according to one or more embodiments.
FIG. 10B illustrates an exploded rear view of a storage area of the modular dispensing unit of FIG. 10A.
FIG. 10C illustrates an exploded view of a portion of a side wall and intermediate wall of the modular dispensing unit of FIG. 10A.
FIG. 10D illustrates an exploded view of a portion of the ice dispenser housing and back wall of the modular dispensing unit of FIG. 10A.
Figure 11B:
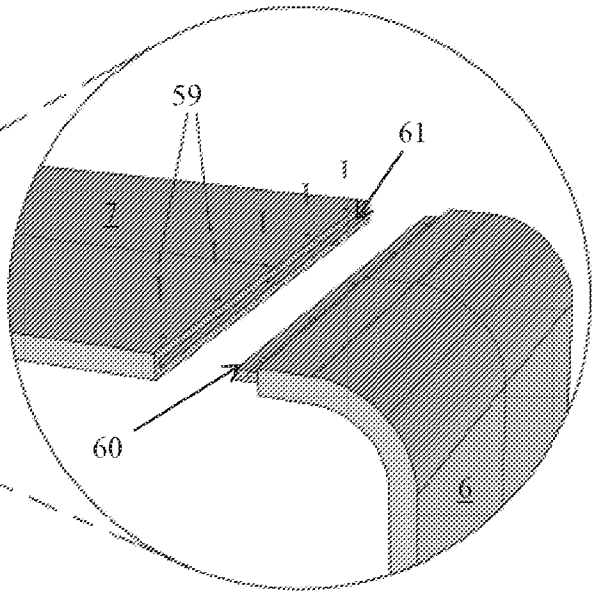
FIG. 11B illustrates an exploded view of a portion of the top wall and a side wall of the modular dispensing unit of FIG. 11A.
Figure 11A:
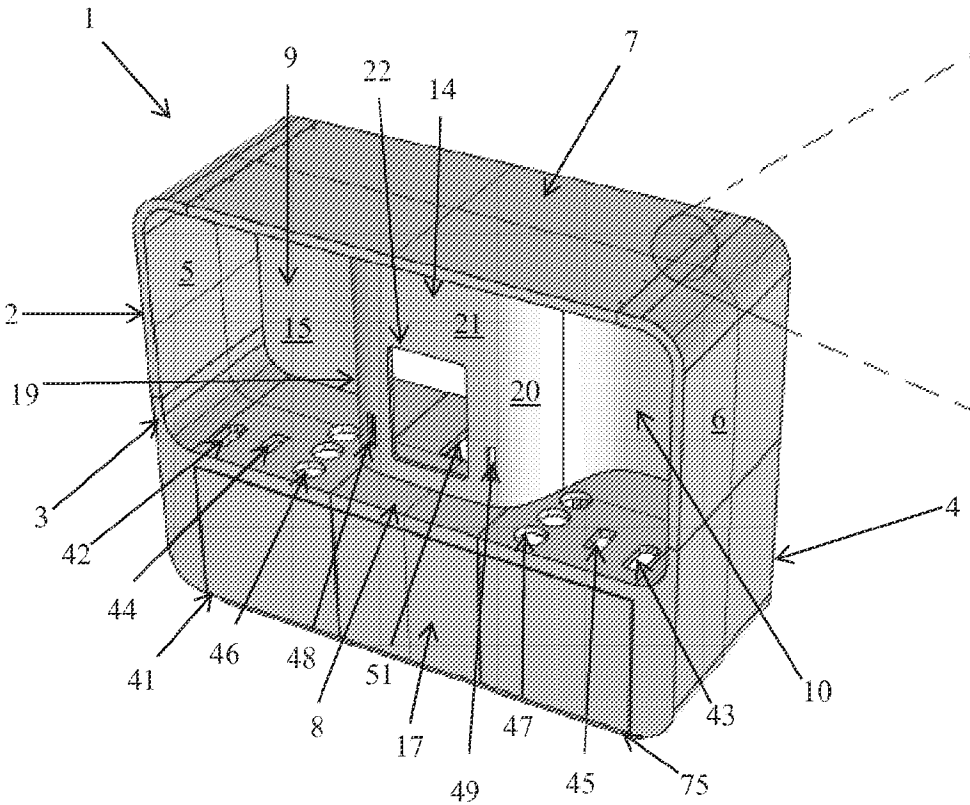
FIG. 11A illustrates an aerial view of a modular dispensing unit according to one or more embodiments.

FIG. 9 illustrates an exploded view of modular dispensing unit 1 according to one or more embodiments. FIG. 10A illustrates a rear view of modular dispensing unit 1 according to one or more embodiments. FIG. 10B illustrates an exploded rear view of a storage area of modular dispensing unit 1 of FIG. 10A. FIG. 10C illustrates an exploded view of a portion of a side wall and intermediate wall of modular dispensing unit 1 of FIG. 10A. FIG. 10D illustrates an exploded view of a portion of the ice dispenser housing and back wall of modular dispensing unit 1 of FIG. 10A. FIG. 11A illustrates an aerial view of modular dispensing unit 1 according to one or more embodiments. FIG. 11B illustrates an exploded view of a portion of the top wall and a side wall of modular dispensing unit 1 of FIG. 11A. FIG. 12 illustrates modular dispensing unit 1 according to one or more embodiments.

FIGS. 9, 10A, 10B, 10C, 10D, 11A and 11B illustrate modular dispensing unit 1, before first beverage dispenser 11 (not shown in FIGS. 9, 10A, 10B, 10C, 10D, 11A and 11B, see FIGS. 1, 12 and 14), second beverage dispenser 12 (not shown in FIGS. 9, 10A, 10B, 10C, 10D, 11A and 11B, see FIGS. 1, 12 and 14) and ice dispenser 13 (not shown in FIGS. 9, 10A, 10B, 10C, 10D, 11A and 11B, see FIGS. 1-3, 5, 6A and 12-14) have been positioned in modular dispensing unit 1, according to one or more embodiments. FIG. 12 illustrates modular dispensing unit 1 after first beverage dispenser 11, second beverage dispenser 12 and ice dispenser 13 have been positioned in modular dispensing unit 1. Modular dispensing unit 1 has a frame 2 having a front side 3, back side 4, two sidewalls 5 and 6, a top wall 7, an intermediate wall 8 and a bottom wall 41. A first enclave 9 and a second enclave 10 are situated within frame 2. An ice dispenser housing 14 is positioned between first enclave 9 and second enclave 10. After constructing and assembling modular dispensing unit 1, an ice dispenser 13 (not shown in FIGS. 9, 10A, 10B, 10C, 10D, 11A and 11B, see FIGS. 1-3, 5, 6A and 12-14) may be positioned within ice dispenser housing 14 between first enclave 9 and second enclave 10, so that ice dispenser housing 14 surrounds substantially the entire ice dispenser 13 (not shown in FIGS. 9, 10A, 10B, 10C, 10D, 11A and 11B, see FIGS. 1-3, 5, 6A and 12-14). Ice dispenser housing 14 may have two housing sidewalls 19 and 20 and a front wall 21, with front wall 21 having an opening 22 that allows access to ice dispenser 13 (not shown in FIGS. 9, 10A, 10B, 10C, 10D, 11A and 11B, see FIGS. 1-3, 5, 6A and 12-14).

In various embodiments, intermediate wall 8 may have a first trash receptacle opening 42 and second trash receptacle opening 43. In certain embodiments, first trash receptacle opening 42 is positioned adjacent to first beverage dispenser 11 (not shown in FIGS. 9, 10A, 10B, 10C, 10D, 11A and 11B, see FIGS. 1, 12 and 14) and second trash receptacle opening 43 is positioned adjacent to second beverage dispenser 12 (not shown in FIGS. 9, 10A, 10B, 10C, 10D, 11A and 11B, see FIGS. 1, 12 and 14), allowing users of both first beverage dispenser 11 (not shown in FIGS. 9, 10A, 10B, 10C, 10D, 11A and 11B, see FIGS. 1, 12 and 14) and second beverage dispenser 12 (not shown in FIGS. 9, 10A, 10B, 10C, 10D, 11A and 11B, see FIGS. 1, 12 and 14) to easily and quickly dispose of trash, focus on the available products, and avoid interfering with the experience of other users.

Intermediate wall 8 may have a first beverage dispenser opening 44 over which first beverage dispenser 11 (not shown in FIGS. 9, 10A, 10B, 10C, 10D, 11A and 11B, see FIGS. 1, 12 and 14) may be positioned. Beverage dispensing equipment, mixing equipment, transferring equipment, electrical cords, tubing, piping, and combinations thereof, for example, may run from first beverage dispenser 11 (not shown in FIGS. 9, 10A, 10B, 10C, 10D, 11A and 11B, see FIGS. 1, 12 and 14) through first beverage dispenser opening 44 to a location underneath intermediate wall 8 (i.e. storage area 17), a location immediately outside modular dispensing unit 1, a remote location (i.e. a room inside the venue) or a combination thereof.

Intermediate wall 8 may have a second beverage dispenser opening 45 over which second beverage dispenser 12 (not shown in FIGS. 9, 10A, 10B, 10C, 10D, 11A and 11B, see FIGS. 1, 12 and 14) may be positioned. Beverage dispensing equipment, mixing equipment, transferring equipment, electrical cords, tubing, piping, and combinations thereof, for example, may run from second beverage dispenser 12 (not shown in FIGS. 9, 10A, 10B, 10C, 10D, 11A and 11B, see FIGS. 1, 12 and 14) through second beverage dispenser opening 45 to a location underneath intermediate wall 8 (i.e. storage area 17), a location immediately outside modular dispensing unit 1, a remote location (i.e. a room inside the venue) or a combination thereof.

Intermediate wall 8 may comprise first recessed pocket(s) or container(s) 46 and second recessed pocket(s) or container(s) 47. First recessed pocket(s) or container(s) 46 and second recessed pocket(s) or container(s) 47 may be used, for example, to store and/or dispense straws, lids or cups below an upper surface of intermediate wall 8. First recessed pocket(s) or container(s) 46 and second recessed pocket(s) or container(s) 47 reduce clutter and further focus consumer attention on the available products. In certain embodiments, first recessed pocket(s) or container(s) 46 are positioned adjacent to first beverage dispenser 11 (not shown in FIGS. 9, 10A, 10B, 10C, 10D, 11A and 11B, see FIGS. 1, 12 and 14) and second recessed pocket(s) or container(s) 47 are positioned adjacent to second beverage dispenser 12 (not shown in FIGS. 9, 10A, 10B, 10C, 10D, 11A and 11B, see FIGS. 1, 12 and 14), allowing users of both first beverage dispenser 11 (not shown in FIGS. 9, 10A, 10B, 10C, 10D, 11A and 11B, see FIGS. 1, 12 and 14) and second beverage dispenser 12 (not shown in FIGS. 9, 10A, 10B, 10C, 10D, 11A and 11B, see FIGS. 1, 12 and 14) to easily and quickly access straws, lids, cups or combinations thereof, focus on the available products, and avoid interfering with the experience of other users.

In certain embodiments, ice dispenser housing 14 may have a first napkin dispenser opening 48 and second napkin dispenser opening 49. In some embodiments, first napkin dispenser opening 48 is positioned adjacent to first beverage dispenser 11 (not shown in FIGS. 9, 10A, 10B, 10C, 10D, 11A and 11B, see FIGS. 1, 12 and 14) and second napkin dispenser opening 49 is positioned adjacent to second beverage dispenser 12 (not shown in FIGS. 9, 10A, 10B, 10C, 10D, 11A and 11B, see FIGS. 1, 12 and 14), allowing users of both first beverage dispenser 11 (not shown in FIGS. 9, 10A, 10B, 10C, 10D, 11A and 11B, see FIGS. 1, 12 and 14) and second beverage dispenser 12 (not shown in FIGS. 9, 10A, 10B, 10C, 10D, 11A and 11B, see FIGS. 1, 12 and 14) to easily and quickly access napkins, focus on the available products, and avoid interfering with the experience of other users. Napkin dispensers (not shown) may be located inside ice dispenser housing 14 adjacent first napkin dispenser opening 48 and second napkin dispenser opening 49.

Frame 2, including front side 3, back side 4, two sidewalls 5 and 6, top wall 7, intermediate wall 8 and bottom wall 41, and ice dispenser housing 14 may be constructed of any suitable materials. Exemplary materials include, but are not limited to, stainless steel, aluminum, plastic, wood and combinations thereof. In some embodiments, the entire frame 2 and/or ice dispenser housing 14 may be made from plastic. In other embodiments, the entire frame 2 and/or ice dispenser housing 14 may be made from stainless steel. In further embodiments, the entire frame 2 and/or ice dispenser housing 14 may be made from aluminum. In yet other embodiments, intermediate wall 8 is stainless steel and the remainder of frame 2 and/or ice dispenser housing 14 is plastic. In still further embodiments, intermediate wall 8 is aluminum and the remainder of frame 2 and/or ice dispenser housing 14 is plastic. In certain embodiments, frame 2 and/or ice dispenser housing 14 may be made from stainless steel, aluminum and plastic.

In various embodiments, ice dispenser housing 14 is a prefabricated unit that may be installed in a frame 2 comprising an intermediate wall 8, two sidewalls 5 and 6 and top wall 7. In other embodiments, ice dispenser housing 14 is of singular construction.

In certain embodiments, modular dispensing unit 1 has a storage area 17 located underneath intermediate wall 8. Storage area 17 is not particularly limited. For example, storage area 17 may comprise cabinets, shelves or a combination thereof. Storage area 17 may be used to house beverage supplies (i.e. straws, lids, cups, etc.), beverage ingredients, carbon dioxide, ice dispenser equipment, beverage dispenser equipment, cooling equipment, trash or combinations thereof.

In various embodiments, frame 2, including back wall 15, bottom wall 41, storage area 17, intermediate wall 8, two sidewalls 5 and 6, top wall 7 and ice dispenser housing 14, is constructed as an open frame in order to facilitate easy assembly and disassembly and hassle-free installation of first beverage dispenser 11 (not shown in FIGS. 9, 10A, 10B, 10C, 10D, 11A and 11B, see FIGS. 1, 12 and 14), second beverage dispenser 12 (not shown in FIGS. 9, 10A, 10B, 10C, 10D, 11A and 11B, see FIGS. 1, 12 and 14), and ice dispenser 13 (not shown in FIGS. 9, 10A, 10B, 10C, 10D, 11A and 11B, see FIGS. 1, 12 and 14).

In certain embodiments, the various individual components of modular dispensing unit 1 (i.e. back wall 15, bottom wall 41, intermediate wall 8, two sidewalls 5 and 6, top wall 7, storage area 17 and ice dispenser housing 14) may be made-up of sub-components. For example, in some embodiments, top wall 7 may comprise two or more sub-top wall components. In other embodiments, back wall 15 may comprise two or more sub-back wall components. In further embodiments, bottom wall 41 may comprise two or more sub-bottom wall components. In certain embodiments, intermediate wall 8 may comprise two or more sub-intermediate wall components. In other embodiments, two sidewalls 5 and 6 may comprise two or more sub-sidewall components. In further embodiments, storage area 17 may comprise two or more sub-storage area components. In still other embodiments, ice dispenser housing 14 may comprise two or more sub-ice dispenser housing components.

In certain embodiments, storage area 17 may have three sub-storage area components. For example, storage area 17 may have a first beverage dispenser cabinet 52, an ice dispenser cabinet 53, and a second beverage dispenser cabinet 54. In some embodiments, first beverage dispenser cabinet 52 may house beverage supplies (i.e. straws, lids, cups, etc.), beverage ingredients, carbon dioxide, beverage dispenser equipment, cooling equipment, trash or combinations thereof associated with first beverage dispenser 11 (not shown in FIGS. 9, 10A, 10B, 10C, 10D, 11A and 11B, see FIGS. 1, 12 and 14). In various embodiments, second beverage dispenser cabinet 54 may house beverage supplies (i.e. straws, lids, cups, etc.), beverage ingredients, carbon dioxide, beverage dispenser equipment, cooling equipment, trash or combinations thereof associated with second beverage dispenser 12 (not shown in FIGS. 9, 10A, 10B, 10C, 10D, 11A and 11B, see FIGS. 1, 12 and 14). In certain embodiments, ice dispenser cabinet 53 may house ice dispenser equipment, cooling equipment, napkins, trash or combinations thereof associated with ice dispenser 13 (not shown in FIGS. 9, 10A, 10B, 10C, 10D, 11A and 11B, see FIGS. 1, 12 and 14).

In certain embodiments, top wall 7 attaches at point 63 to a top curved portion of sidewall 6, sidewall 6 attaches via a lower portion to an upper curved portion of intermediate wall 8 at point 64, second beverage dispenser cabinet 54 attaches to ice dispenser cabinet 53 at point 65 via cabinet attachment points 73, ice dispenser cabinet 53 attaches to first beverage dispenser cabinet 52 at point 66 via cabinet attachment points 73, an upper curved portion of intermediate wall 8 attaches to a lower portion of sidewall 5 at point 67, and a top curved portion of sidewall 5 attaches to top wall 7 at point 62. In further embodiments, back wall 15 is curved and comprises two curved sub-back wall components, one attaching to housing sidewall 19 via housing attachments 55 and the other attaching to housing sidewall 20 via housing attachments 55. In some embodiments, back wall 15 is curved and is placed, along with ice dispenser housing 14, in corresponding grooves 50 in intermediate wall 8. In certain embodiments, grooves 50 further comprise tracks. In other embodiments, back wall 15 is curved and is placed, along with ice dispenser housing 14, directly on intermediate wall 8. In further embodiments, back wall 15 is curved and is attached, along with ice dispenser housing 14, to intermediate wall 8. In still further embodiments, back wall 15 is curved and back wall 15, ice dispenser housing 14, and intermediate wall 8 are of unitary construction.

In some embodiments, an ice dispenser opening 51 is present in intermediate wall 8, over which ice dispenser 13 (not shown in FIGS. 9, 10A, 10B, 10C, 10D, 11A and 11B, see FIGS. 1-3, 5, 6A and 12-14) may be positioned. Ice dispensing equipment, ice making equipment, cooling equipment, transferring equipment, electrical cords, tubing, piping, and combinations thereof, for example, may run from ice dispenser 13 (not shown in FIGS. 9, 10A, 10B, 10C, 10D, 11A and 11B, see FIGS. 1-3, 5, 6A and 12-14) through ice dispenser opening 51 to a location underneath intermediate wall 8 (i.e. storage area 17), a location immediately outside modular dispensing unit 1, a remote location (i.e. a room inside the venue) or a combination thereof.

Any suitable attachment mechanism may be used. Suitable attachment mechanisms include, but are not limited to, glue, epoxy, adhesive, tape, screws, nails, nuts and bolts, key pins, tongue and groove construction, welding, molding or combinations thereof. In certain embodiments, sidewall 5 is attached to intermediate wall 8 via key pins 56. In some embodiments, two housing sidewalls 19 and 20 attach to back wall 15 via housing attachments 55, and housing attachments 55 utilize nuts 58 and bolts 57. In various embodiments, top wall 7 attaches to two sidewalls 5 and 6 using tongue 60 and groove 61 construction. Tongue 60 and groove 61 construction creates strong joints between frame 2 components. In certain embodiments, screws 59 (i.e. wood screws) secure frame 2 components in place and enable easy assembly and disassembly.

In some embodiments, top wall 7 may further comprise a first spotlight 68 (not shown in FIGS. 9, 10A, 10B, 10C, 10D, 11A and 11B, see FIG. 14) located above first beverage dispenser 11 (not shown in FIGS. 9, 10A, 10B, 10C, 10D, 11A and 11B, see FIGS. 1, 12 and 14) and a second spotlight 69 (not shown in FIGS. 9, 10A, 10B, 10C, 10D, 11A and 11B, see FIG. 14) located above second beverage dispenser 12 (not shown in FIGS. 9, 10A, 10B, 10C, 10D, 11A and 11B, see FIGS. 1, 12 and 14). In certain embodiments, first spotlight 68 (not shown in FIGS. 9, 10A, 10B, 10C, 10D, 11A and 11B, see FIG. 14) and second spotlight 69 (not shown in FIGS. 9, 10A, 10B, 10C, 10D, 11A and 11B, see FIG. 14) are recessed in top wall 7. First spotlight 68 (not shown in FIGS. 9, 10A, 10B, 10C, 10D, 11A and 11B, see FIG. 14) and second spotlight 69 (not shown in FIGS. 9, 10A, 10B, 10C, 10D, 11A and 11B, see FIG. 14) are not limited to any particular kind of light.

In further embodiments, modular dispensing unit 1 may further comprise a motion detector that activates first spotlight 68 (not shown in FIGS. 9, 10A, 10B, 10C, 10D, 11A and 11B, see FIG. 14) above first beverage dispenser 11 (not shown in FIGS. 9, 10A, 10B, 10C, 10D, 11A and 11B, see FIGS. 1, 12 and 14) based on the presence of a user in front of first beverage dispenser 11 (not shown in FIGS. 9, 10A, 10B, 10C, 10D, 11A and 11B, see FIGS. 1, 12 and 14). In other embodiments, modular dispensing unit 1 may further comprise a gesture detector that activates first spotlight 68 (not shown in FIGS. 9, 10A, 10B, 10C, 10D, 11A and 11B, see FIG. 14) above first beverage dispenser 11 (not shown in FIGS. 9, 10A, 10B, 10C, 10D, 11A and 11B, see FIGS. 1, 12 and 14) based on one or more gestures made by a user in front of first beverage dispenser 11 (not shown in FIGS. 9, 10A, 10B, 10C, 10D, 11A and 11B, see FIGS. 1, 12 and 14).

In some embodiments, modular dispensing unit 1 may further comprise a motion detector that activates second spotlight 69 (not shown in FIGS. 9, 10A, 10B, 10C, 10D, 11A and 11B, see FIG. 14) above second beverage dispenser 12 (not shown in FIGS. 9, 10A, 10B, 10C, 10D, 11A and 11B, see FIGS. 1, 12 and 14) based on the presence of a user in front of second beverage dispenser 12 (not shown in FIGS. 9, 10A, 10B, 10C, 10D, 11A and 11B, see FIGS. 1, 12 and 14). In other embodiments, modular dispensing unit 1 may further comprise a gesture detector that activates second spotlight 69 (not shown in FIGS. 9, 10A, 10B, 10C, 10D, 11A and 11B, see FIG. 14) above second beverage dispenser 12 (not shown in FIGS. 9, 10A, 10B, 10C, 10D, 11A and 11B, see FIGS. 1, 12 and 14) based on one or more gestures made by a user in front of second beverage dispenser 12 (not shown in FIGS. 9, 10A, 10B, 10C, 10D, 11A and 11B, see FIGS. 1, 12 and 14).

In certain embodiments, modular dispensing unit 1 may further comprise a front panel 16 (not shown in FIGS. 9, 10A, 10B, 10C, 10D, 11A and 11B, see FIG. 1) attached or connected to front side 3 via top wall 7 and/or sidewalls 5 and/or 6. Intermediate wall 8, two sidewalls 5 and 6, top wall 7 and front panel 16 (not shown in FIGS. 9, 10A, 10B, 10C, 10D, 11A and 11B, see FIG. 1) of modular dispensing unit 1 may be of unitary construction, singular construction, or a combination thereof.

In various embodiments, modular dispensing unit 1 may further have an advertisement, logo, brand name, or design 36 (not shown in FIGS. 9, 10A, 10B, 10C, 10D, 11A and 11B, see FIGS. 2, 3, 5, 6A, 7A, 7B, 13 and 14) located on or adjacent to modular dispensing unit 1. For example, an advertisement, logo, brand name, or design 36 (not shown in FIGS. 9, 10A, 10B, 10C, 10D, 11A and 11B, see FIGS. 2, 3, 5, 6A, 7A, 7B, 13 and 14) may be located on or adjacent to bottom wall 41, front side 3, back side 4, back wall 15, sidewalls 5 and/or 6, top wall 7, intermediate wall 8, front panel 16 (not shown in FIGS. 9, 10A, 10B, 10C, 10D, 11A and 11B, see FIG. 1), storage area 17, ice dispenser housing 14 or a combination thereof.

Base 75 may be positioned underneath bottom wall 41. In various embodiments, base 75 and bottom wall 41 may be of unitary construction or singular construction. In some embodiments base 75 is attached to bottom wall 41. In other embodiments, base 75 and bottom wall 41 are of unitary construction. In certain embodiments, base 75 may be attached to the floor of the venue. Examples of base 75 include, but are not limited to, a platform, wheels, casters, legs, pegs, blocks, or a combination thereof.

In various embodiments, ice dispenser housing 14 is not attached to ice dispenser 13 (not shown in FIGS. 9, 10A, 10B, 10C, 10D, 11A and 11B, see FIGS. 1-3, 5, 6A and 12-14). In certain embodiments, ice dispenser housing 14 is attached to back side 4, back wall 15, intermediate wall 8, two sidewalls 5 and/or 6, top wall 7, or a combination thereof. In some embodiments, ice dispenser housing 14 is attached to back side 4. In other embodiments, ice dispenser housing 14 is attached to back wall 15. In further embodiments, ice dispenser housing 14 is attached to intermediate wall 8. In still other embodiments, ice dispenser housing 14 is attached to two sidewalls 5 and 6. In still further embodiments, ice dispenser housing 14 is attached to top wall 7. In other embodiments, ice dispenser housing 14 is attached to a wall of the venue when modular dispensing unit 1 is installed in the venue.

In order to minimize the appearance of ice dispenser 13 (not shown in FIGS. 9, 10A, 10B, 10C, 10D, 11A and 11B, see FIGS. 1-3, 5, 6A and 12-14) and frame the consumer experience, ice dispenser housing 14 may be the same or similar color as a wall of the venue when modular dispensing unit 1 is installed in the venue. Matching the color of ice dispenser housing 14 to a wall of the venue allows ice dispenser 13 (not shown in FIGS. 9, 10A, 10B, 10C, 10D, 11A and 11B, see FIGS. 1-3, 5, 6A and 12-14) to essentially blend in with the wall of the venue. When ice dispenser housing 14 blends in with the wall of the venue, the consumer then focuses on the available products and branding information. A cohesive beverage dispensing experience is created and the size (i.e. the width, depth and height) of ice dispenser 13 (not shown in FIGS. 9, 10A, 10B, 10C, 10D, 11A and 11B, see FIGS. 1-3, 5, 6A and 12-14) is hidden without any loss of functionality. Further, when a frame 2 is present and ice dispenser housing 14 is the same or similar color as the wall of the venue, the consumer is less likely to be distracted by the chaos of the venue and equipment. In essence, the user experience becomes framed and the consumer is more able to focus on the available products.

In some embodiments, ice dispenser housing 14 is the same or similar color as a covering positioned on or adjacent to the wall of the venue when modular dispensing unit 1 is installed in the venue. Such covering is not particularly limited. The covering may be, for example, made of paint, cloth/fabric, paper, plastic, metal, cardboard, paperboard or a combination thereof.

In certain embodiments, back side 4 comprises a back wall 15, and back wall 15 is the same or similar color as a wall of the venue when the modular dispensing unit is installed in the venue. In further embodiments, ice dispenser housing 14 and back wall 15 are the same or similar color as a wall of the venue when modular dispensing unit 1 is installed in the venue. In certain embodiments, ice dispenser housing 14 and back wall 15 are of unitary construction and are the same or similar color as a wall of the venue when modular dispensing unit 1 is installed in the venue.

In one or more embodiments, ice dispenser housing 14 and back wall 15 are the same or similar color as a covering positioned on or adjacent to the wall of the venue when modular dispensing unit 1 is installed in the venue. Such covering is not particularly limited. The covering may be, for example, made of paint, cloth/fabric, paper, plastic, metal, cardboard, paperboard or a combination thereof.

In some embodiments, frame 2 of modular dispensing unit 1, including front side 3, back side 4, two sidewalls 5 and 6, top wall 7, intermediate wall 8, storage area 17 and bottom wall 41, is the same or similar color as a wall of the venue when modular dispensing unit 1 is installed in the venue. The wall of the venue is not particularly limited. In various embodiments, the wall of the venue may be, for example, made of cloth/fabric, wood, drywall, concrete, bricks, metal, stone or a combination thereof.

In certain embodiments, frame 2 of modular dispensing unit 1, including front side 3, back side 4, two sidewalls 5 and 6, top wall 7, intermediate wall 8, storage area 17 and bottom wall 41, is the same or similar color as a covering positioned on or adjacent to the wall of the venue when modular dispensing unit 1 is installed in the venue. Such covering is not particularly limited. The covering may be, for example, made of paint, cloth/fabric, paper, plastic, metal, cardboard, paperboard or a combination thereof.

Modular dispensing unit 1 may be constructed and/or assembled off-site and then transported to an intended venue, constructed and/or assembled on-site, or a combination thereof. For example, in some embodiments, the entire modular dispensing unit 1 may be constructed and/or assembled off-site and then transported to the intended venue. In other embodiments, the entire modular dispensing unit 1 may be constructed and/or assembled on-site at the intended venue. In yet other embodiments, components of modular dispensing unit 1 (i.e. frame 2) may be constructed off-site, transported to the intended venue and then assembled with the remaining modular dispensing unit 1 components.

Exemplary venues include, but are not limited to, restaurants, gas stations, convenience stores, theaters, convention centers, shopping malls, sporting arenas and stadiums, airports, cafeterias and other entertainment and/or food service sites. In various embodiments, modular dispensing unit 1 may be installed on a wall of a venue, against a wall of a venue, adjacent to a wall of a venue, embedded in a wall of a venue or a combination thereof. In certain embodiments, frame 2 may define a wall of the venue. In other embodiments, frame 2 and a wall of the venue are of unitary construction. In some embodiments, upon installation, frame 2 becomes one with a wall of the venue.

In various embodiments, modular dispensing unit 1 is sized so that it may be easily transported and installed in the intended venue. For example, in some embodiments, modular dispensing unit 1 is sized so that a fully constructed and/or assembled unit may fit in an elevator.

Placing ice dispenser 13 (not shown in FIGS. 9, 10A, 10B, 10C, 10D, 11A and 11B, see FIGS. 1-3, 5, 6A and 12-14) surrounded by ice dispenser housing 14 between first beverage dispenser 11 (not shown in FIGS. 9, 10A, 10B, 10C, 10D, 11A and 11B, see FIGS. 1, 12 and 14) and second beverage dispenser 12 (not shown in FIGS. 9, 10A, 10B, 10C, 10D, 11A and 11B, see FIGS. 1, 12 and 14) allows for a semi-private user experience and further focuses consumer attention on the available products. In certain embodiments, two housing sidewalls 19 and 20 are attached to a wall of the venue when modular dispensing unit 1 is installed in the venue. In some embodiments, two housing sidewalls 19 and 20 are attached to back wall 15. In further embodiments, two housing sidewalls 19 and 20 and back wall 15 are of unitary construction.

FIG. 12 illustrates modular dispensing unit 1 after first beverage dispenser 11, second beverage dispenser 12 and ice dispenser 13 have been positioned in modular dispensing unit 1. Ice dispenser 13 is not limited to any particular ice dispensing machine. In certain embodiments, ice dispenser 13 has an ice storage unit, an ice making unit or a combination thereof. For example, in some embodiments, ice dispenser 13 stores and dispenses ice, but does not make the ice. In other embodiments, ice dispenser 13 makes, stores and dispenses the ice. In certain embodiments, ice dispenser 13 comprises an ice maker stacked on top of an ice storage and/or dispensing unit.

Ice dispenser housing 14 may have two housing sidewalls 19 and 20 and a front wall 21, with front wall 21 having an opening 22 that allows access to ice dispenser 13. A window 26 may be used for a graphic treatment, advertisement, logo, brand name, or design 36. An integrated bezel/nozzle cover 24 may at least partially cover ice outlet 23 of ice dispenser 13. A lever 74, either existing from ice dispenser 13 or a part of ice dispenser housing 14, is accessible through opening 22.

Placing ice dispenser 13 surrounded by ice dispenser housing 14 between first beverage dispenser 11 and second beverage dispenser 12 allows for a semi-private user experience and further focuses consumer attention on the available products. In various embodiments, ice dispenser housing 14 does not attach to ice dispenser 13. For example, in some embodiments, ice dispenser housing 14 may fit over ice dispenser 13 like a sleeve or around ice dispenser 13 like a mask. In certain embodiments, two housing sidewalls 19 and 20 are attached to a wall of the venue when modular dispensing unit 1 is installed in the venue. In other embodiments, ice dispenser housing 14 may attach to ice dispenser 13 at one or more attachment/anchoring points. In some embodiments, two housing sidewalls 19 and 20 are attached to back wall 15. In further embodiments, two housing sidewalls 19 and 20 and back wall 15 are of unitary construction.

First beverage dispenser 11 and second beverage dispenser 12 are not limited to any particular type of beverage dispenser. FIGS. 1, 2, 7A, 7B, 12 and 14 show first beverage dispenser 11 and second beverage dispenser 12 according to one or more embodiments. In certain embodiments, first beverage dispenser 11 and second beverage dispenser 12 may comprise towers having one or more dispensing heads 38 from which one or more beverages may be dispensed. First beverage dispenser 11 and second beverage dispenser 12 may dispense hot or cold beverages. In various embodiments, first beverage dispenser 11 and second beverage dispenser 12 may dispense carbonated beverages, soft drinks, sodas, colas, juices, teas, water or combinations thereof.

In certain embodiments, first beverage dispenser 11 and/or second beverage dispenser 12 may have drip pan 40 positioned below one or more dispensing heads 38. In various embodiments, first beverage dispenser 11 and/or second beverage dispenser 12 may further comprise screen 39 where the consumer may view information about the available products and the particular beverage ordered by the consumer. In certain embodiments, screen 39 is a touchscreen that allows the consumer to interact with first beverage dispenser 11 and/or second beverage dispenser 12. In various embodiments, first beverage dispenser 11 and/or second beverage dispenser 12 may further have an advertisement, logo, brand name, or design 36 located on first beverage dispenser 11 and/or second beverage dispenser 12.

First beverage dispenser 11 and second beverage dispenser 12 may further have lights. For example, in certain embodiments, first beverage dispenser 11 and/or second beverage dispenser 12 may have a light positioned adjacent to one or more dispensing heads 38, above one or more dispensing heads 38, below one or more dispensing heads 38, surrounding one or more dispensing heads 38, within one or more dispensing heads 38, or a combination thereof. Such lights are not limited to any particular kind of light.

In further embodiments, modular dispensing unit 1 may further comprise a motion detector that activates a first beverage dispenser light, such light positioned adjacent to one or more dispensing heads 38 of first beverage dispenser 11, above one or more dispensing heads 38 of first beverage dispenser 11, below one or more dispensing heads 38 of first beverage dispenser 11, surrounding one or more dispensing heads 38 of first beverage dispenser 11, or within one or more dispensing heads 38 of first beverage dispenser 11, based on the presence of a user in front of first beverage dispenser 11. In other embodiments, modular dispensing unit 1 may further comprise a gesture detector that activates a first beverage dispenser light, such light positioned adjacent to one or more dispensing heads 38 of first beverage dispenser 11, above one or more dispensing heads 38 of first beverage dispenser 11, below one or more dispensing heads 38 of first beverage dispenser 11, surrounding one or more dispensing heads 38 of first beverage dispenser 11, or within one or more dispensing heads 38 of first beverage dispenser 11, based on one or more gestures made by a user in front of first beverage dispenser 11.

In further embodiments, modular dispensing unit 1 may further comprise a motion detector that activates a second beverage dispenser light, such light positioned adjacent to one or more dispensing heads 38 of second beverage dispenser 12, above one or more dispensing heads 38 of second beverage dispenser 12, below one or more dispensing heads 38 of second beverage dispenser 12, surrounding one or more dispensing heads 38 of second beverage dispenser 12, or within one or more dispensing heads 38 of second beverage dispenser 12, based on the presence of a user in front of second beverage dispenser 12. In other embodiments, modular dispensing unit 1 may further comprise a gesture detector that activates a second beverage dispenser light, such light positioned adjacent to one or more dispensing heads 38 of second beverage dispenser 12, above one or more dispensing heads 38 of second beverage dispenser 12, below one or more dispensing heads 38 of second beverage dispenser 12, surrounding one or more dispensing heads 38 of second beverage dispenser 12, or within one or more dispensing heads 38 of second beverage dispenser 12, based on one or more gestures made by a user in front of second beverage dispenser 12.

First beverage dispenser 11 and second beverage dispenser 12 may utilize any suitable dispensing technology. For example, first beverage dispenser 11 and second beverage dispenser 12 may use traditional fountain drink mixing and/or dispensing equipment and methods. The mixing and/or transferring equipment may be located in storage area 17 or in a remote location. For example, the mixing and/or transferring equipment may be located in a room inside the venue.

Figure 13:
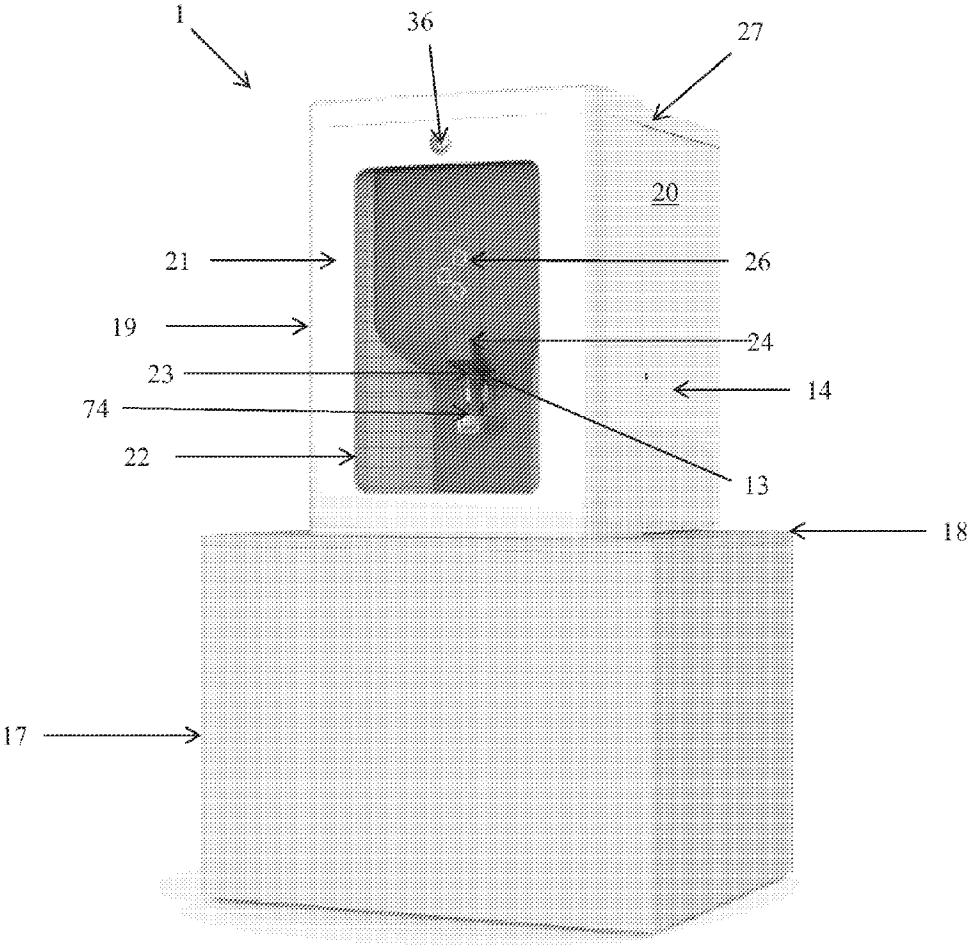
FIG. 13 illustrates a modular dispensing unit according to one or more embodiments.

FIG. 13 illustrates modular dispensing unit 1 according to another embodiment. Modular dispensing unit 1 may have a countertop 18 on which an ice dispenser 13 is located. An ice dispenser housing 14 surrounds substantially the entire ice dispenser 13. A storage area 17 is located underneath countertop 18.

Storage area 17 is not particularly limited. For example, storage area 17 may comprise cabinets, shelves or a combination thereof. Storage area 17 may be used to house beverage supplies (i.e. straws, lids, cups, etc.), beverage ingredients, carbon dioxide, ice dispenser equipment, beverage dispenser equipment, cooling equipment, trash or combinations thereof.

Ice dispenser housing 14 may have two housing sidewalls 19 and 20 and a front wall 21, with front wall 21 having an opening 22 that allows access to ice dispenser 13. Ice dispenser housing 14 may also have a lid 27, so that ice may be loaded into ice dispenser 13. A window 26 may be used for a graphic treatment, advertisement, logo, brand name, or design 36. An integrated bezel/nozzle cover 24 may at least partially cover ice outlet 23 of ice dispenser 13. A lever 74, either existing from ice dispenser 13 or a part of ice dispenser housing 14, is accessible through opening 22.

In various embodiments, countertop 18 may have a first trash receptacle opening 42 (not shown in FIG. 13, see FIGS. 1, 8, 9, 11A and 14) and second trash receptacle opening 43 (not shown in FIG. 13, see FIGS. 1, 8, 9, 11A and 14). In certain embodiments, first trash receptacle opening 42 (not shown in FIG. 13, see FIGS. 1, 8, 9, 11A and 14) is positioned adjacent to housing sidewall 19 and second trash receptacle opening 43 (not shown in FIG. 13, see FIGS. 1, 8, 9, 11A and 14) is positioned adjacent to housing sidewall 20.

In some embodiments, countertop 18 may comprise first recessed pocket(s) or container(s) 46 (not shown in FIG. 13, see FIGS. 1, 8, 9, 10B, 10C, 11A and 14) and second recessed pocket(s) or container(s) 47 (not shown in FIG. 13, see FIGS. 1, 8, 9, 10B, 10C, 11A and 14). First recessed pocket(s) or container(s) 46 (not shown in FIG. 13, see FIGS. 1, 8, 9, 10B, 10C, 11A and 14) and second recessed pocket(s) or container(s) 47 (not shown in FIG. 13, see FIGS. 1, 8, 9, 10B, 10C, 11A and 14) may be used, for example, to store and/or dispense straws, lids or cups below an upper surface of countertop 18. First recessed pocket(s) or container(s) 46 (not shown in FIG. 13, see FIGS. 1, 8, 9, 10B, 10C, 11A and 14) and second recessed pocket(s) or container(s) 47 (not shown in FIG. 13, see FIGS. 1, 8, 9, 10B, 10C, 11A and 14) reduce clutter and further focus consumer attention on the available products. In certain embodiments, first recessed pocket(s) or container(s) 46 (not shown in FIG. 13, see FIGS. 1, 8, 9, 10B, 10C, 11A and 14) are positioned adjacent to housing sidewall 19 and second recessed pocket(s) or container(s) 47 (not shown in FIG. 13, see FIGS. 1, 8, 9, 10B, 10C, 11A and 14) are positioned adjacent to housing sidewall 20.

In certain embodiments, ice dispenser housing 14 may have a first napkin dispenser opening 48 (not shown in FIG. 13, see FIGS. 1, 8, 9, 10A, 11B, 12 and 14) and second napkin dispenser opening 49 (not shown in FIG. 13, see FIGS. 1, 8, 9, 10A, 11B, 12 and 14). In some embodiments, first napkin dispenser opening 48 (not shown in FIG. 13, see FIGS. 1, 8, 9, 10A, 11B, 12 and 14) is positioned adjacent to housing sidewall 19 and second napkin dispenser opening 49 (not shown in FIG. 13, see FIGS. 1, 8, 9, 10A, 11B, 12 and 14) is positioned adjacent to housing sidewall 20. Napkin dispensers (not shown) may be located inside ice dispenser housing 14 adjacent first napkin dispenser opening 48 (not shown in FIG. 13, see FIGS. 1, 8, 9, 10A, 11B, 12 and 14) and second napkin dispenser opening 49 (not shown in FIG. 13, see FIGS. 1, 8, 9, 10A, 11B, 12 and 14).

In various embodiments, ice dispenser housing 14 does not cover an ice outlet 23 (i.e. an ice chute or nozzle) of ice dispenser 13. In certain embodiments, ice dispenser housing 14 is attached to countertop 18. In other embodiments, ice dispenser housing 14 and countertop 18 are of unitary construction. In other embodiments, ice dispenser housing 14, countertop 18 and storage area 17 are of unitary construction. In yet other embodiments, ice dispenser housing 14, countertop 18, storage area 17 or a combination thereof are attached to a wall of a venue when modular dispensing unit 1 is installed in the venue. In certain embodiments, ice dispenser housing 14 is attached to a wall of a venue when modular dispensing unit 1 is installed in the venue. In further embodiments, countertop 18 and/or storage area 17 are attached to a wall of a venue when modular dispensing unit 1 is installed in the venue. In other embodiments, ice dispenser housing 14, countertop 18 and storage area 17 are attached to a wall of a venue when modular dispensing unit 1 is installed in the venue.

Any suitable attachment mechanism may be used. Suitable attachment mechanisms include, but are not limited to, glue, epoxy, adhesive, tape, screws, nails, nuts and bolts, key pins, tongue and groove construction, welding, molding or combinations thereof.

Countertop 18 may be constructed of any suitable materials. Exemplary materials include, but are not limited to, stainless steel, aluminum, plastic, wood and combinations thereof. In some embodiments, countertop 18 may be made from plastic. In other embodiments, countertop 18 may be made from stainless steel. In further embodiments, countertop 18 may be made from aluminum. In yet other embodiments, countertop 18 is stainless steel and plastic. In still further embodiments, countertop 18 is aluminum and plastic.

In order to minimize the appearance and size of ice dispenser 13 and frame the consumer experience, ice dispenser housing 14 may be the same or similar color as a wall of the venue when modular dispensing unit 1 is installed in the venue. Matching the color of ice dispenser housing 14 allows ice dispenser 13 to essentially blend in with the wall of the venue. When ice dispenser housing 14 blends in with the wall of the venue, the consumer then focuses on the available products and branding information. Further, when ice dispenser housing 14 is the same or similar color as the wall of the venue, the consumer is less likely to be distracted by the chaos of the venue and equipment. In essence, the consumer is more able to focus on the available products.

In some embodiments, ice dispenser housing 14 is the same or similar color as a covering positioned on or adjacent to the wall of the venue when modular dispensing unit 1 is installed in the venue. Such covering is not particularly limited. The covering may be, for example, made of paint, cloth/fabric, paper, plastic, metal, cardboard, paperboard or a combination thereof.

Modular dispensing unit 1 may be constructed and/or assembled off-site and then transported to an intended venue, constructed and/or assembled on-site, or a combination thereof. For example, in some embodiments, the entire modular dispensing unit 1 may be constructed and/or assembled off-site and then transported to the intended venue. In other embodiments, the entire modular dispensing unit 1 may be constructed and/or assembled on-site at the intended venue. In yet other embodiments, components of modular dispensing unit 1 may be constructed off-site, transported to the intended venue and then assembled with the remaining modular dispensing unit 1 components.

Exemplary venues include, but are not limited to, restaurants, gas stations, convenience stores, theaters, convention centers, shopping malls, sporting arenas and stadiums, airports, cafeterias and other entertainment and/or food service sites. In various embodiments, modular dispensing unit 1 may be installed on a wall of a venue, against a wall of a venue, adjacent to a wall of a venue, embedded in a wall of a venue or a combination thereof. In certain embodiments, modular dispensing unit 1 may define a wall of the venue. In other embodiments, modular dispensing unit 1 and a wall of the venue are of unitary construction. In some embodiments, upon installation, modular dispensing unit 1 becomes one with a wall of the venue.

In various embodiments, modular dispensing unit 1 is sized so that it may be easily transported and installed in the intended venue. For example, in some embodiments, modular dispensing unit 1 is sized so that a fully constructed and/or assembled unit may fit in an elevator.

Ice dispenser 13 is not limited to any particular ice dispensing machine. In certain embodiments, ice dispenser 13 has an ice storage unit, an ice making unit or a combination thereof. For example, in some embodiments, ice dispenser 13 stores and dispenses ice, but does not make the ice. In other embodiments, ice dispenser 13 makes, stores and dispenses the ice. In certain embodiments, ice dispenser 13 comprises an ice maker stacked on top of an ice storage and/or dispensing unit.

In various embodiments, ice dispenser housing 14 does not attach to ice dispenser 13. For example, in some embodiments, ice dispenser housing 14 may fit over ice dispenser 13 like a sleeve or around ice dispenser 13 like a mask. In certain embodiments, two housing sidewalls 19 and 20 are attached to a wall of the venue when modular dispensing unit 1 is installed in the venue. In other embodiments, ice dispenser housing 14 may attach to ice dispenser 13 at one or more attachment/anchoring points.

In various embodiments, modular dispensing unit 1 may further have an advertisement, logo, brand name, or design 36 located on or adjacent to modular dispensing unit 1. For example, an advertisement, logo, brand name, or design 36 may be located on or adjacent to countertop 18, storage area 17, first beverage dispenser 11, second beverage dispenser 12, ice dispenser housing 14 or a combination thereof.

FIG. 14 illustrates a modular dispensing unit according to one or more embodiments. Modular dispensing unit 1 has a frame 2 having a front side 3, back side 4, two sidewalls 5 and 6, a top wall 7, an intermediate wall 8 and a bottom wall 41. A first enclave 9 and a second enclave 10 are situated within frame 2. A first beverage dispenser 11 is located in first enclave 9. A second beverage dispenser 12 is located in second enclave 10. An ice dispenser 13 is positioned between first enclave 9 and second enclave 10. An ice dispenser housing 14 surrounds substantially the entire ice dispenser 13. Ice dispenser housing 14 may have two housing sidewalls 19 and 20 and a front wall 21, with front wall 21 having an opening 22 that allows access to an ice outlet 23 of ice dispenser 13. A window 26 may be used for a graphic treatment, advertisement, logo, brand name, or design 36. An integrated bezel/nozzle cover 24 may at least partially cover ice outlet 23 of ice dispenser 13. A lever 74, either existing from ice dispenser 13 or a part of ice dispenser housing 14, is accessible through opening 22.

Frame 2, including front side 3, back side 4, two sidewalls 5 and 6, top wall 7, intermediate wall 8 and bottom wall 41, and ice dispenser housing 14 may be constructed of any suitable materials. Exemplary materials include, but are not limited to, stainless steel, aluminum, plastic, wood and combinations thereof. In some embodiments, the entire frame 2 and/or ice dispenser housing 14 may be made from plastic. In other embodiments, the entire frame 2 and/or ice dispenser housing 14 may be made from stainless steel. In further embodiments, the entire frame 2 and/or ice dispenser housing 14 may be made from aluminum. In yet other embodiments, intermediate wall 8 is stainless steel and the remainder of frame 2 and/or ice dispenser housing 14 is plastic. In still further embodiments, intermediate wall 8 is aluminum and the remainder of frame 2 and/or ice dispenser housing 14 is plastic. In certain embodiments, frame 2 and/or ice dispenser housing 14 may be made from stainless steel, aluminum and plastic.

In certain embodiments, ice dispenser housing 14 is a prefabricated unit that may be installed in a frame 2 comprising an intermediate wall 8, two sidewalls 5 and 6 and top wall 7 of singular construction. In various embodiments, frame 2, including back wall 15, bottom wall 41, storage area 17, intermediate wall 8, two sidewalls 5 and 6, top wall 7 and ice dispenser housing 14, is constructed as an open frame in order to facilitate easy assembly and disassembly and hassle-free installation of first beverage dispenser 11, second beverage dispenser 12, and ice dispenser 13.

In FIG. 14, modular dispensing unit 1 has a storage area 17 located underneath intermediate wall 8. Storage area 17 is not particularly limited. For example, storage area 17 may comprise cabinets, shelves or a combination thereof. Storage area 17 may be used to house beverage supplies (i.e. straws, lids, cups, etc.), beverage ingredients, carbon dioxide, ice dispenser equipment, beverage dispenser equipment, cooling equipment, trash or combinations thereof.

Back side 4 of modular dispensing unit 1 of FIG. 14 comprises back wall 15. Back wall 15, bottom wall 41, intermediate wall 8, two sidewalls 5 and 6, top wall 7, storage area 17 and ice dispenser housing 14 of modular dispensing unit 1 may be of unitary construction, singular construction, or a combination thereof. In certain embodiments, the various individual components of modular dispensing unit 1 (i.e. back wall 15, bottom wall 41, intermediate wall 8, two sidewalls 5 and 6, top wall 7, storage area 17 and ice dispenser housing 14) may be made-up of sub-components. For example, in some embodiments, top wall 7 may comprise two or more sub-top wall components. In other embodiments, back wall 15 may comprise two or more sub-back wall components. In further embodiments, bottom wall 41 may comprise two or more sub-bottom wall components. In certain embodiments, intermediate wall 8 may comprise two or more sub-intermediate wall components. In other embodiments, two sidewalls 5 and 6 may comprise two or more sub-sidewall components. In further embodiments, storage area 17 may comprise two or more sub-storage area components. In still other embodiments, ice dispenser housing 14 may comprise two or more sub-ice dispenser housing components.

In certain embodiments, storage area 17 may have three sub-storage area components. For example, storage area 17 may have a first beverage dispenser cabinet 52, an ice dispenser cabinet 53, and a second beverage dispenser cabinet 54. In some embodiments, first beverage dispenser cabinet 52 may house beverage supplies (i.e. straws, lids, cups, etc.), beverage ingredients, carbon dioxide, beverage dispenser equipment, cooling equipment, trash or combinations thereof associated with first beverage dispenser 11. In various embodiments, second beverage dispenser cabinet 54 may house beverage supplies (i.e. straws, lids, cups, etc.), beverage ingredients, carbon dioxide, beverage dispenser equipment, cooling equipment, trash or combinations thereof associated with second beverage dispenser 12. In certain embodiments, ice dispenser cabinet 53 may house ice dispenser equipment, cooling equipment, napkins, trash or combinations thereof associated with ice dispenser 13.

In certain embodiments, top wall 7 attaches at point 63 to a top curved portion of sidewall 6, sidewall 6 attaches via a lower portion to an upper curved portion of intermediate wall 8 at point 64, second beverage dispenser cabinet 54 attaches to ice dispenser cabinet 53 at point 65 via cabinet attachment points 73, ice dispenser cabinet 53 attaches to first beverage dispenser cabinet 52 at point 66 via cabinet attachment points 73, an upper curved portion of intermediate wall 8 attaches to a lower portion of sidewall 5 at point 67, and a top curved portion of sidewall 5 attaches to top wall 7 at point 62.

Any suitable attachment mechanism may be used. Suitable attachment mechanisms include, but are not limited to, glue, epoxy, adhesive, tape, screws, nails, nuts and bolts, key pins, tongue and groove construction, welding, molding or combinations thereof. Tongue and groove construction creates strong joints between frame 2 components. In certain embodiments, screws (i.e. wood screws) secure frame 2 components in place and enable easy assembly and disassembly.

Top wall 7 of modular dispensing unit 1 of FIG. 14 further comprises a first spotlight 68 located above first beverage dispenser 11 and a second spotlight 69 located above second beverage dispenser 12. In certain embodiments, first spotlight 68 and second spotlight 69 are recessed in top wall 7. First spotlight 68 and second spotlight 69 are not limited to any particular kind of light.

In further embodiments, modular dispensing unit 1 may further comprise a motion detector that activates first spotlight 68 above first beverage dispenser 11 based on the presence of a user in front of first beverage dispenser 11. In other embodiments, modular dispensing unit 1 may further comprise a gesture detector that activates first spotlight 68 above first beverage dispenser 11 based on one or more gestures made by a user in front of first beverage dispenser 11.

In some embodiments, modular dispensing unit 1 may further comprise a motion detector that activates second spotlight 69 above second beverage dispenser 12 based on the presence of a user in front of second beverage dispenser 12. In other embodiments, modular dispensing unit 1 may further comprise a gesture detector that activates second spotlight 69 above second beverage dispenser 12 based on one or more gestures made by a user in front of second beverage dispenser 12.

Intermediate wall 8 of modular dispensing unit 1 of FIG. 14 comprises first recessed pocket(s) or container(s) 46 positioned adjacent to first beverage dispenser 11 and second recessed pocket(s) or container(s) 47 positioned adjacent to second beverage dispenser 12. First recessed pocket(s) or container(s) 46 and second recessed pocket(s) or container(s) 47 may be used, for example, to store and/or dispense straws, lids 72 or cups 71 below an upper surface of intermediate wall 8. The positioning of first recessed pocket(s) or container(s) 46 and second recessed pocket(s) or container(s) 47 reduces clutter and allows users of both first beverage dispenser 11 and second beverage dispenser 12 to easily and quickly access straws, lids 72, cups 71 or combinations thereof, focus on the available products, and avoid interfering with the experience of other users.

Intermediate wall 8 of modular dispensing unit 1 of FIG. 14 has a first trash receptacle opening 42 positioned adjacent to first beverage dispenser 11 and second trash receptacle opening 43 positioned adjacent to second beverage dispenser 12. The positioning of first trash receptacle opening 42 and second trash receptacle opening 43 allows users of both first beverage dispenser 11 and second beverage dispenser 12 to easily and quickly dispose of trash, focus on the available products, and avoid interfering with the experience of other users.

Ice dispenser housing 14 of modular dispensing unit 1 of FIG. 14 has a first napkin dispenser opening 48 positioned adjacent to first beverage dispenser 11 and second napkin dispenser opening 49 positioned adjacent to second beverage dispenser 12. The positioning of first napkin dispenser opening 48 and second napkin dispenser opening 49 allows users of both first beverage dispenser 11 and second beverage dispenser 12 to easily and quickly access napkins, focus on the available products, and avoid interfering with the experience of other users. Napkin dispensers (not shown) may be located inside ice dispenser housing 14 adjacent first napkin dispenser opening 48 and second napkin dispenser opening 49.

In certain embodiments, modular dispensing unit 1 may further comprise a front panel 16 (not shown in FIG. 14, see FIG. 1) attached or connected to front side 3 via top wall 7 and/or sidewalls 5 and/or 6. Intermediate wall 8, two sidewalls 5 and 6, top wall 7 and front panel 16 (not shown in FIG. 14, see FIG. 1) of modular dispensing unit 1 may be of unitary construction, singular construction, or a combination thereof.

Modular dispensing unit 1 of FIG. 14 has an advertisement, logo, brand name, or design 36 located on or adjacent to modular dispensing unit 1. Advertisement, logo, brand name, or design 36 is located on or adjacent to first beverage dispenser 11 (not shown in FIG. 14, see FIGS. 2, 7A and 7B), second beverage dispenser 12 and ice dispenser housing 14.

Base 75 may be positioned underneath bottom wall 41. In various embodiments, base 75 and bottom wall 41 may be of unitary construction or singular construction. In some embodiments base 75 is attached to bottom wall 41. In other embodiments, base 75 and bottom wall 41 are of unitary construction. In certain embodiments, base 75 may be attached to the floor of the venue. Examples of base 75 include, but are not limited to, a platform, wheels, casters, legs, pegs, blocks, or a combination thereof.

In various embodiments, ice dispenser housing 14 is not attached to ice dispenser 13. In certain embodiments, ice dispenser housing 14 is attached to back side 4, back wall 15, intermediate wall 8, two sidewalls 5 and/or 6, top wall 7, or a combination thereof. In some embodiments, ice dispenser housing 14 is attached to back side 4. In other embodiments, ice dispenser housing 14 is attached to back wall 15. In further embodiments, ice dispenser housing 14 is attached to intermediate wall 8. In still other embodiments, ice dispenser housing 14 is attached to two sidewalls 5 and 6. In still further embodiments, ice dispenser housing 14 is attached to top wall 7. In other embodiments, ice dispenser housing 14 is attached to a wall of the venue when modular dispensing unit 1 is installed in the venue.

Any suitable attachment mechanism may be used. Suitable attachment mechanisms include, but are not limited to, glue, epoxy, adhesive, tape, screws, nails, nuts and bolts, key pins, tongue and groove construction, welding, molding or combinations thereof.

Frame 2 of modular dispensing unit 1 of FIG. 14, including front side 3, back side 4, two sidewalls 5 and 6, top wall 7, intermediate wall 8, storage area 17 and bottom wall 41, is the same or similar color as a wall 70 of the venue when modular dispensing unit 1 is installed in the venue. Wall 70 of FIG. 14 is a curtain. However, wall 70 is not particularly limited. In various embodiments, wall 70 may be, for example, made of cloth/fabric, wood, drywall, concrete, bricks, metal, stone or a combination thereof. In certain embodiments, frame 2 of modular dispensing unit 1 of FIG. 14, including front side 3, back side 4, two sidewalls 5 and 6, top wall 7, intermediate wall 8, storage area 17 and bottom wall 41, is the same or similar color as a covering positioned on or adjacent to wall 70 of the venue when modular dispensing unit 1 is installed in the venue. Such covering is not particularly limited. The covering may be, for example, made of paint, cloth/fabric, paper, plastic, metal, cardboard, paperboard or a combination thereof.

In other embodiments, in order to minimize the appearance of ice dispenser 13 and frame the consumer experience, ice dispenser housing 14 may be the same or similar color as a wall 70 of the venue when modular dispensing unit 1 is installed in the venue. Matching the color of ice dispenser housing 14 to a wall 70 of the venue allows ice dispenser 13 to essentially blend in with the wall 70 of the venue. When ice dispenser housing 14 blends in with the wall 70 of the venue, the consumer then focuses on the available products and branding information. A cohesive beverage dispensing experience is created and the size (i.e. the width, depth and height) of ice dispenser 13 is hidden without any loss of functionality. Further, when a frame 2 is present and ice dispenser housing 14 is the same or similar color as the wall 70 of the venue, the consumer is less likely to be distracted by the chaos of the venue and equipment. In essence, the user experience becomes framed and the consumer is more able to focus on the available products.

In certain embodiments, ice dispenser housing 14 is the same or similar color as a covering positioned on or adjacent to wall 70 of the venue when modular dispensing unit 1 is installed in the venue. Such covering is not particularly limited. The covering may be, for example, made of paint, cloth/fabric, paper, plastic, metal, cardboard, paperboard or a combination thereof.

In certain embodiments, back side 4 comprises a back wall 15, and back wall 15 is the same or similar color as a wall of the venue when the modular dispensing unit is installed in the venue. In further embodiments, ice dispenser housing 14 and back wall 15 are the same or similar color as a wall of the venue when modular dispensing unit 1 is installed in the venue. In certain embodiments, ice dispenser housing 14 and back wall 15 are of unitary construction and are the same or similar color as a wall of the venue when modular dispensing unit 1 is installed in the venue.

Modular dispensing unit 1 may be constructed and/or assembled off-site and then transported to an intended venue, constructed and/or assembled on-site, or a combination thereof. For example, in some embodiments, the entire modular dispensing unit 1 may be constructed and/or assembled off-site and then transported to the intended venue. In other embodiments, the entire modular dispensing unit 1 may be constructed and/or assembled on-site at the intended venue. In yet other embodiments, components of modular dispensing unit 1 (i.e. frame 2) may be constructed off-site, transported to the intended venue and then assembled with the remaining modular dispensing unit 1 components.

Exemplary venues include, but are not limited to, restaurants, gas stations, convenience stores, theaters, convention centers, shopping malls, sporting arenas and stadiums, airports, cafeterias and other entertainment and/or food service sites. In various embodiments, modular dispensing unit 1 may be installed on a wall of a venue, against a wall of a venue, adjacent to a wall of a venue, embedded in a wall of a venue or a combination thereof. In certain embodiments, frame 2 may define a wall of the venue. In other embodiments, frame 2 and a wall of the venue are of unitary construction. In some embodiments, upon installation, frame 2 becomes one with a wall of the venue.

In various embodiments, modular dispensing unit 1 is sized so that it may be easily transported and installed in the intended venue. For example, in some embodiments, modular dispensing unit 1 is sized so that a fully constructed and/or assembled unit may fit in an elevator.

Ice dispenser 13 is not limited to any particular ice dispensing machine. In certain embodiments, ice dispenser 13 has an ice storage unit, an ice making unit or a combination thereof. For example, in some embodiments, ice dispenser 13 stores and dispenses ice, but does not make the ice. In other embodiments, ice dispenser 13 makes, stores and dispenses the ice. In certain embodiments, ice dispenser 13 comprises an ice maker stacked on top of an ice storage and/or dispensing unit.

Placing ice dispenser 13 surrounded by ice dispenser housing 14 between first beverage dispenser 11 and second beverage dispenser 12 allows for a semi-private user experience and further focuses consumer attention on the available products. In various embodiments, ice dispenser housing 14 does not attach to ice dispenser 13. For example, in some embodiments, ice dispenser housing 14 may fit over ice dispenser 13 like a sleeve or around ice dispenser 13 like a mask. In certain embodiments, two housing sidewalls 19 and 20 are attached to a wall of the venue when modular dispensing unit 1 is installed in the venue. In other embodiments, ice dispenser housing 14 may attach to ice dispenser 13 at one or more attachment/anchoring points. In some embodiments, two housing sidewalls 19 and 20 are attached to back wall 15. In further embodiments, two housing sidewalls 19 and 20 and back wall 15 are of unitary construction.

First beverage dispenser 11 and second beverage dispenser 12 are not limited to any particular type of beverage dispenser. FIGS. 1, 2, 7A, 7B, 12 and 14 show first beverage dispenser 11 and second beverage dispenser 12 according to one or more embodiments. In certain embodiments, first beverage dispenser 11 and second beverage dispenser 12 may comprise towers having one or more dispensing heads 38 from which one or more beverages may be dispensed. First beverage dispenser 11 and second beverage dispenser 12 may dispense hot or cold beverages. In various embodiments, first beverage dispenser 11 and second beverage dispenser 12 may dispense carbonated beverages, soft drinks, sodas, colas, juices, teas, water or combinations thereof.

In certain embodiments, first beverage dispenser 11 and/or second beverage dispenser 12 may have drip pan 40 positioned below one or more dispensing heads 38. In various embodiments, first beverage dispenser 11 and/or second beverage dispenser 12 may further comprise screen 39 where the consumer may view information about the available products and the particular beverage ordered by the consumer. In certain embodiments, screen 39 is a touchscreen that allows the consumer to interact with first beverage dispenser 11 and/or second beverage dispenser 12. In various embodiments, first beverage dispenser 11 and/or second beverage dispenser 12 may further have an advertisement, logo, brand name, or design 36 located on first beverage dispenser 11 and/or second beverage dispenser 12.

First beverage dispenser 11 and second beverage dispenser 12 may further have lights. For example, in certain embodiments, first beverage dispenser 11 and/or second beverage dispenser 12 may have a light positioned adjacent to one or more dispensing heads 38, above one or more dispensing heads 38, below one or more dispensing heads 38, surrounding one or more dispensing heads 38, within one or more dispensing heads 38, or a combination thereof. Such lights are not limited to any particular kind of light.

In further embodiments, modular dispensing unit 1 may further comprise a motion detector that activates a first beverage dispenser light, such light positioned adjacent to one or more dispensing heads 38 of first beverage dispenser 11, above one or more dispensing heads 38 of first beverage dispenser 11, below one or more dispensing heads 38 of first beverage dispenser 11, surrounding one or more dispensing heads 38 of first beverage dispenser 11, or within one or more dispensing heads 38 of first beverage dispenser 11, based on the presence of a user in front of first beverage dispenser 11. In other embodiments, modular dispensing unit 1 may further comprise a gesture detector that activates a first beverage dispenser light, such light positioned adjacent to one or more dispensing heads 38 of first beverage dispenser 11, above one or more dispensing heads 38 of first beverage dispenser 11, below one or more dispensing heads 38 of first beverage dispenser 11, surrounding one or more dispensing heads 38 of first beverage dispenser 11, or within one or more dispensing heads 38 of first beverage dispenser 11, based on one or more gestures made by a user in front of first beverage dispenser 11.

In further embodiments, modular dispensing unit 1 may further comprise a motion detector that activates a second beverage dispenser light, such light positioned adjacent to one or more dispensing heads 38 of second beverage dispenser 12, above one or more dispensing heads 38 of second beverage dispenser 12, below one or more dispensing heads 38 of second beverage dispenser 12, surrounding one or more dispensing heads 38 of second beverage dispenser 12, or within one or more dispensing heads 38 of second beverage dispenser 12, based on the presence of a user in front of second beverage dispenser 12. In other embodiments, modular dispensing unit 1 may further comprise a gesture detector that activates a second beverage dispenser light, such light positioned adjacent to one or more dispensing heads 38 of second beverage dispenser 12, above one or more dispensing heads 38 of second beverage dispenser 12, below one or more dispensing heads 38 of second beverage dispenser 12, surrounding one or more dispensing heads 38 of second beverage dispenser 12, or within one or more dispensing heads 38 of second beverage dispenser 12, based on one or more gestures made by a user in front of second beverage dispenser 12.

First beverage dispenser 11 and second beverage dispenser 12 may utilize any suitable dispensing technology. For example, first beverage dispenser 11 and second beverage dispenser 12 may use traditional fountain drink mixing and/or dispensing equipment and methods. The mixing and/or transferring equipment may be located in storage area 17 or in a remote location. For example, the mixing and/or transferring equipment may be located in a room inside the venue.

Various embodiments are drawn to a modular dispensing unit comprising: a frame having a front side, back side, two sidewalls, a top wall, an intermediate wall and a bottom wall; a first enclave and a second enclave within the frame; a first beverage dispenser located in the first enclave; a second beverage dispenser located in the second enclave; an ice dispenser positioned between the first enclave and the second enclave; and an ice dispenser housing surrounding substantially the entire ice dispenser.

In certain embodiments, the intermediate wall, two sidewalls and top wall are of unitary construction.

In some embodiments, the back side comprises a back wall, and the back wall, intermediate wall, two sidewalls and top wall are of unitary construction.

In further embodiments, the ice dispenser housing is attached to the back wall.

In still further embodiments, the back side comprises a back wall attached to the two sidewalls, the top wall and the intermediate wall, and the ice dispenser housing is attached to the back wall.

In certain embodiments, the top wall further comprises a first spotlight located above the first beverage dispenser and a second spotlight located above the second beverage dispenser.

In various embodiments, the first spotlight and the second spotlight are recessed in the top wall.

In some embodiments, modular dispensing unit further comprises a motion detector that activates the first spotlight above the first beverage dispenser based on the presence of a user in front of the first beverage dispenser.

In one or more embodiments, the ice dispenser housing is attached to a wall of a venue when the modular dispensing unit is installed in the venue.

In various embodiments, the ice dispenser housing is the same or similar color as a wall of a venue when the modular dispensing unit is installed in the venue.

In certain embodiments, the back side comprises a back wall, and the back wall is the same or similar color as a wall of a venue when the modular dispensing unit is installed in the venue.

In some embodiments, the back side comprises a back wall, and the back wall and the ice dispenser housing are of unitary construction.

Various embodiments are drawn to a modular dispensing unit comprising: a frame having a front side, back side, two sidewalls, a top wall, an intermediate wall and a bottom wall; a first enclave and a second enclave within the frame; a first beverage dispenser located in the first enclave; a second beverage dispenser located in the second enclave; an ice dispenser positioned between the first enclave and the second enclave; and an ice dispenser housing surrounding the ice dispenser and having two housing sidewalls and a front wall, wherein the front wall has an opening that allows access to an ice outlet of the ice dispenser.

In certain embodiments, the two housing sidewalls and the front wall are of unitary construction.

In some embodiments, the ice dispenser housing does not attach to the ice dispenser.

In one or more embodiments, the two housing sidewalls are attached to a wall of a venue when the modular dispensing unit is installed in the venue.

In various embodiments, the ice dispenser housing is the same or similar color as a wall of a venue when the modular dispensing unit is installed in the venue.

In some embodiments, the back side comprises a back wall, and the back wall and the ice dispenser housing are of unitary construction.

Various embodiments are drawn to a modular dispensing unit comprising: a frame having a front side, back side, two sidewalls, a top wall, an intermediate wall and a bottom wall, wherein the intermediate wall, two sidewalls and top wall are of unitary construction; a first enclave and a second enclave within the frame; a first beverage dispenser located in the first enclave; a second beverage dispenser located in the second enclave; an ice dispenser positioned between the first enclave and the second enclave; and an ice dispenser housing surrounding the ice dispenser and having two housing sidewalls and a front wall, wherein the front wall has an opening that allows access to an ice outlet of the ice dispenser, and wherein the ice dispenser housing is the same or similar color as a wall of a venue when the modular dispensing unit is installed adjacent to or embedded in the wall of the venue.

In certain embodiments, the intermediate wall, two sidewalls, top wall and ice dispenser housing are of unitary construction.

Figure 15:
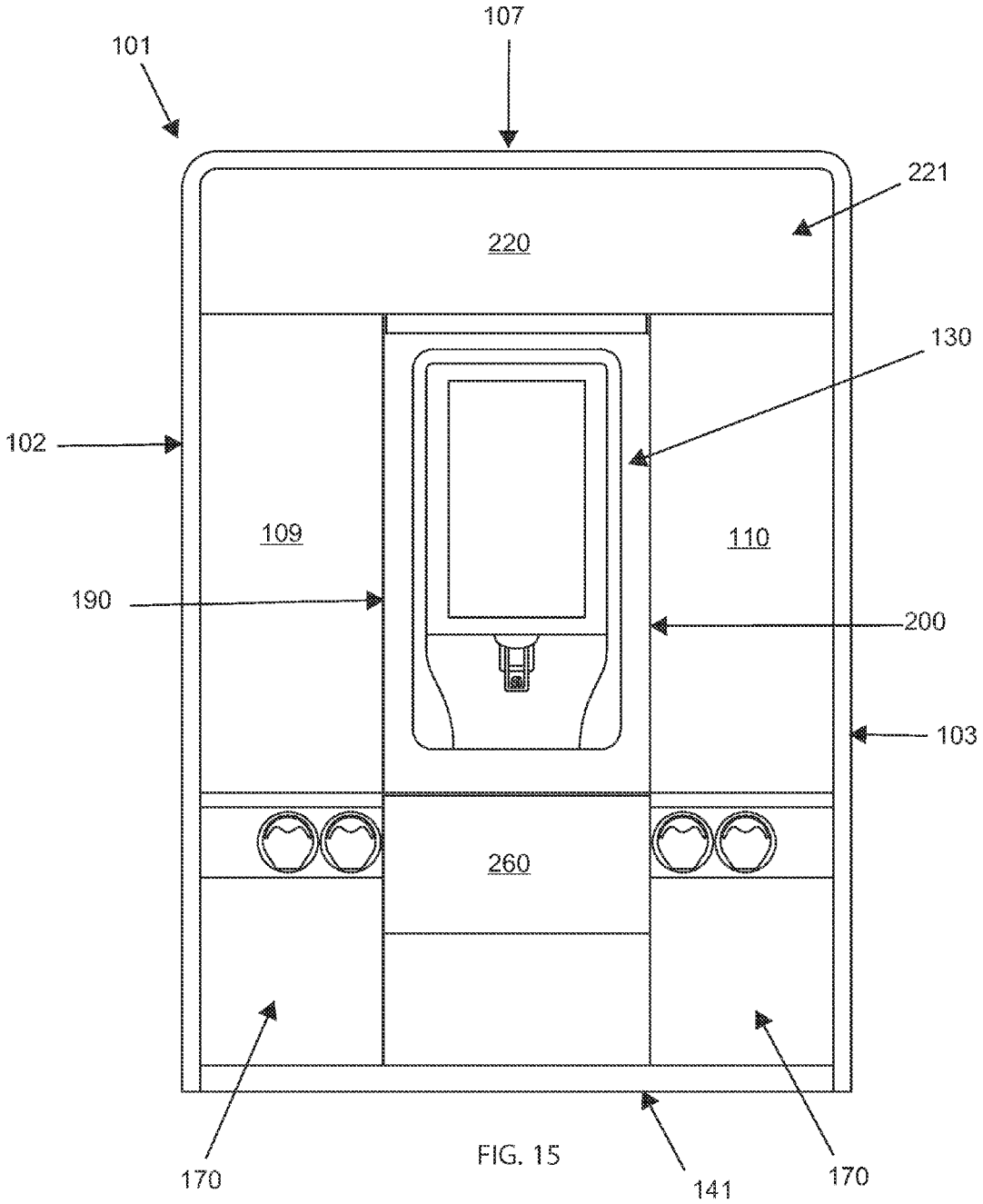
FIG. 15 illustrates an additional modular dispensing unit in accordance with one or more embodiments of the disclosure.
Figure 16:
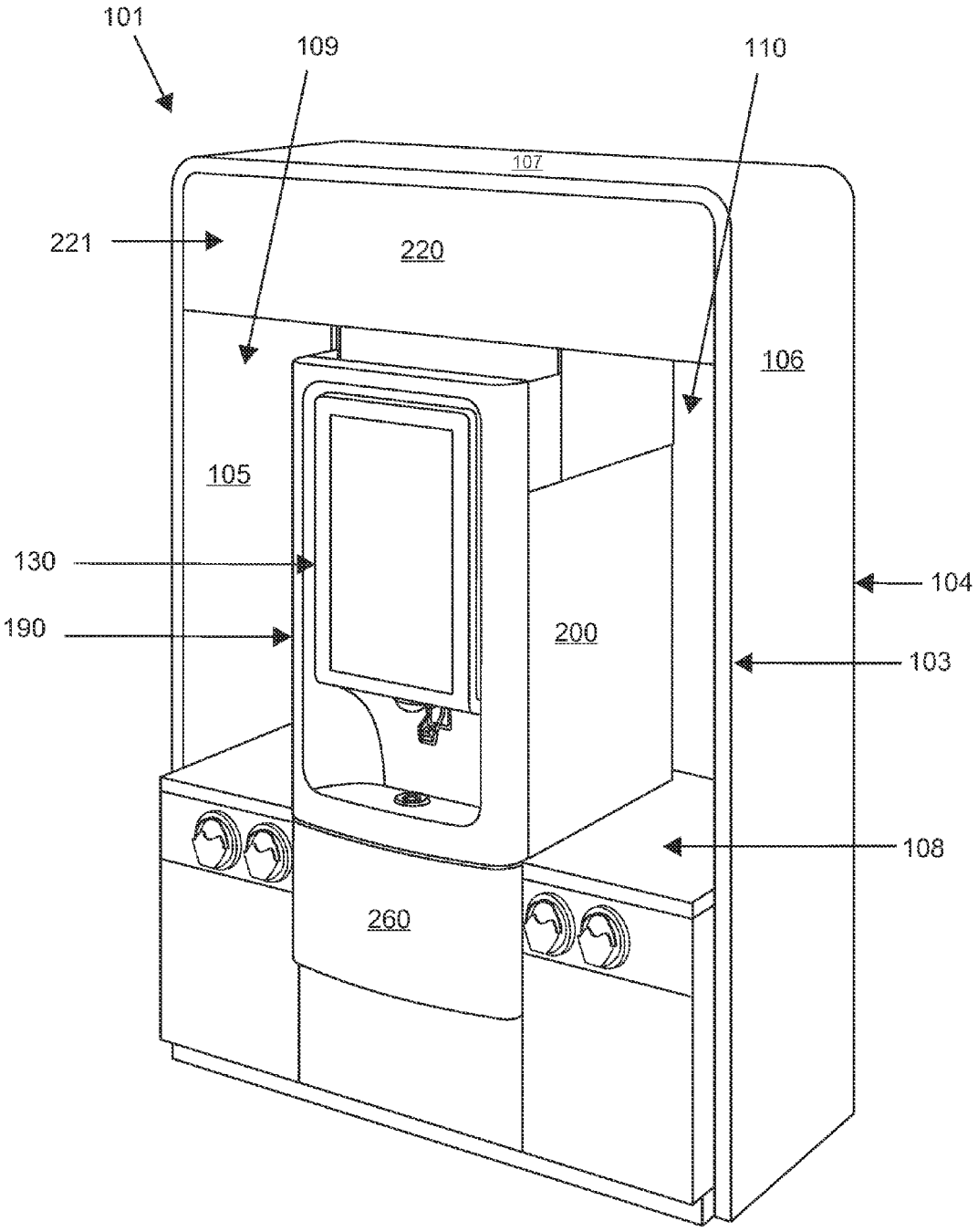
FIG. 16 illustrates a side perspective view of the additional modular dispensing unit of FIG. 15.

FIGS. 15 and 16 illustrate another modular dispensing unit 101 according to one or more embodiments. In an embodiment, modular dispensing unit 101 may include a frame 102 having a front side 103, back side 104, two sidewalls 105 and 106, a top wall 107, an intermediate wall 108 and a bottom wall 141. A first enclave 109 and a second enclave 110 may be situated within frame 102. A beverage dispenser 130 may be positioned on intermediate wall 108 forming first enclave 109 and second enclave 110. Beverage dispenser 130 may also include two housing sidewalls 190 and 200 which may along with sidewalls 105 and 106 define first enclave 109 and second enclave 110.

Frame 102 may also include a removable top portion 220 to allow access to components of beverage dispenser 130. For instance, an integrated ice machine may be accessed by removal of top portion 220. In an embodiment, top portion 220 may also include a window 221 displaying a graphic, advertisement, logo, brand name, and/or design.

Frame 102, including front side 103, back side 104, two sidewalls 105 and 106, top wall 107, intermediate wall 108 and bottom wall 141, and sidewalls 190 and 200 may be constructed of any suitable materials. Exemplary materials include, but are not limited to, stainless steel, aluminum, plastic, wood and combinations thereof. In some embodiments, the entire frame 102 may be made from plastic. In other embodiments, the entire frame 102 may be made from stainless steel or aluminum. In yet other embodiments, intermediate wall 108 may be made from stainless steel and the remainder of frame 102 may be made from a different material such as plastic.

In an embodiment, bottom wall 141, intermediate wall 108, two sidewalls 105 and 106, and top wall 107 may be of unitary construction, singular construction, or a combination thereof. In certain embodiments, bottom wall 141, intermediate wall 108, two sidewalls 105 and 106 and top wall 107 of modular dispensing unit 101 are of unitary construction. In further embodiments, some of frame 102 components may be of unitary construction while other components are of singular construction. For example, intermediate wall 108 and two sidewalls 105 and 106 of modular dispensing unit 101 may be of unitary construction, while top wall 107 is of singular construction. In other embodiments, top wall 107 and two sidewalls 105 and 106 of modular dispensing unit 101 may be of unitary construction, while intermediate wall 108 is of singular construction.

In certain embodiments, modular dispensing unit 101 has storage areas 170 located underneath intermediate wall 108. Storage areas 170 are not particularly limited. For example, storage areas 170 may comprise cabinets, shelves or a combination thereof. Storage areas 170 may be used to house beverage supplies (i.e. straws, lids, cups, etc.), beverage ingredients, carbon dioxide, ice dispenser equipment, beverage dispenser equipment, cooling equipment, trash or combinations thereof.

Modular dispensing unit 101 may be constructed and/or assembled off-site and then transported to an intended venue, constructed and/or assembled on-site, or a combination thereof. For example, in some embodiments, the entire modular dispensing unit 101 may be constructed and/or assembled off-site and then transported to the intended venue. In other embodiments, the entire modular dispensing unit 101 may be constructed and/or assembled on-site at the intended venue. In yet other embodiments, components of modular dispensing unit 101 (i.e. frame 102) may be constructed off-site, transported to the intended venue and then assembled with the remaining modular dispensing unit 101 components.

Exemplary venues include, but are not limited to, restaurants, gas stations, convenience stores, theaters, convention centers, shopping malls, sporting arenas and stadiums, airports, cafeterias and other entertainment and/or food service sites. In various embodiments, modular dispensing unit 101 may be installed on a wall of a venue, against a wall of a venue, adjacent to a wall of a venue, embedded in a wall of a venue or a combination thereof. In certain embodiments, frame 102 may define a wall of the venue. In other embodiments, frame 102 and a wall of the venue are of unitary construction. In some embodiments, upon installation, frame 102 becomes one with a wall of the venue.

In various embodiments, modular dispensing unit 101 is sized so that it may be easily transported and installed in the intended venue. For example, in some embodiments, modular dispensing unit 101 is sized so that a fully constructed and/or assembled unit may fit in an elevator.

In another embodiment, modular dispensing unit 101 including frame 102 may position beverage dispenser 130 so that beverage dispenser 130 extends beyond intermediate wall 108 enabling users to easily access beverage dispenser 130 and its associated user interface. In an embodiment, as shown in FIG. 16, intermediate wall 108 may also project beyond two sidewalls 105 and 106 which may allow beverage dispenser 130 to extend even further into a location. In embodiment, cover 260 may be positioned below beverage dispenser 130.

The various embodiments are not to be limited in scope by the specific embodiments disclosed in the examples. The specific embodiments disclosed in the examples are intended as illustrations of a few aspects, and any embodiments that are functionally equivalent are within the scope of this disclosure. Indeed, various modifications of the various embodiments in addition to those shown and described herein will become apparent and are intended to fall within the scope of the appended claims.

Although certain ice dispensers, ice dispenser housings and beverage dispensers are used to illustrate certain variations, the various embodiments are suitable for the preparation of any modular dispensing unit disclosed herein, using any of the components disclosed herein. With the benefit of the present disclosure, one skilled in the art will recognize that various parameters may need to be adjusted to compensate for the use of a different component.

The terms used in the present specification shall be understood to have the meaning usually used in the field of art to which the various embodiments pertain, unless otherwise specified.

Where products are described herein as having, including, or comprising specific components, or where processes are described herein as having, including, or comprising specific process steps, it is contemplated that the products of the various embodiments can also consist essentially of, or consist of, the recited components, and that the processes of the various embodiments also consist essentially of, or consist of, the recited process steps.

Where a range of values is provided, each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure. For example, a numerical range of "1 to 5" should be interpreted to include not only the explicitly recited values of 1 and 5, but also individual values and sub-ranges within the indicated range. Thus, included in this numerical range are individual values such as 2, 3, 4, etc. and sub-ranges such as from 1 to 3, from 2 to 4, from 3-5, etc. The listing of exemplary values or ranges is not a disclaimer of other values or ranges between and including the upper and lower limits of a given range.

Certain ranges are presented herein with numerical values being preceded by the term "about." The term "about" is used herein to provide literal support for the exact number that it precedes, as well as a number that is near to or approximately the number that the term precedes. In determining whether a number is near to or approximately a specifically recited number, the near or approximating unrequited number may be a number, which, in the context in which it is presented, provides the substantial equivalent of the specifically recited number.

It is noted that, as used herein and in the appended claims, the singular forms "a," "an," and "the" include plural references unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Each of the individual embodiments described and illustrated herein has discrete components and features which may be readily separated from or combined with the features of any of the other several embodiments without departing from the scope or spirit of the disclosure. Any recited method can be carried out in the order of events recited or in any other order which is logically possible.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. A modular dispensing unit comprising:

a frame having a front side, back side, two sidewalls, a top wall and a bottom wall;

a first enclave defined by one of the sidewalls, the back side, the front side, the top wall, an intermediate wall, and an ice dispenser housing sidewall;

a second enclave defined by one of the sidewalls, the back side, the front side, the top wall, an intermediate wall, and a second ice dispenser housing sidewall;

a first beverage dispenser located in the first enclave;

a second beverage dispenser located in the second enclave;

an ice dispenser positioned between the first enclave and the second enclave; and an ice dispenser housing surrounding substantially the entire ice dispenser.

2. The modular dispensing unit of claim 1, wherein the bottom wall, two sidewalls and top wall are of unitary construction.

3. The modular dispensing unit of claim 1, wherein the back side comprises a back wall, and the back wall, bottom wall, two sidewalls and top wall are of unitary construction.

4. The modular dispensing unit of claim 3, wherein the ice dispenser housing is attached to the back wall.

5. The modular dispensing unit of claim 1, wherein the back side comprises a back wall attached to the two sidewalls, the top wall and the bottom wall, and the ice dispenser housing is attached to the back wall.

6. The modular dispensing unit of claim 1, wherein the top wall further comprises a first spotlight located above the first beverage dispenser and a second spotlight located above the second beverage dispenser.

7. The modular dispensing unit of claim 6, wherein the first spotlight and the second spotlight are recessed in the top wall.

8. The modular dispensing unit of claim 6, further comprising a motion detector that activates the first spotlight above the first beverage dispenser based on the presence of a user in front of the first beverage dispenser.

9. The modular dispensing unit of claim 1, wherein the ice dispenser housing is attached to a wall of a venue when the modular dispensing unit is installed in the venue.

10. The modular dispensing unit of claim 1, wherein the ice dispenser housing is the same or similar color as a wall of a venue when the modular dispensing unit is installed adjacent to or embedded in the wall of the venue.

11. The modular dispensing unit of claim 1, wherein the back side comprises a back wall, and the back wall is the same or similar color as a wall of a venue when the modular dispensing unit is installed adjacent to or embedded in the wall of the venue.

12. The modular dispensing unit of claim 1, wherein the back side comprises a back wall, and the back wall and the ice dispenser housing are of unitary construction.

13. A modular dispensing unit comprising:

a frame having a front side, back side, two sidewalls, a top wall and a bottom wall;

a first enclave and a second enclave within the frame;

a first beverage dispenser located in the first enclave;

a second beverage dispenser located in the second enclave;

an ice dispenser positioned between the first enclave and the second enclave; and an ice dispenser housing surrounding the ice dispenser and having the two housing sidewalls and a front wall, wherein the front wall has an opening that allows access to an ice outlet of the ice dispenser, and wherein the two housing sidewalls are attached to a wall of a venue when the modular dispensing unit is installed in the venue.

14. The modular dispensing unit of claim 13, wherein the two housing sidewalls and the front wall are of unitary construction.

15. The modular dispensing unit of claim 13, wherein the ice dispenser housing does not attach to the ice dispenser.

16. The modular dispensing unit of claim 13, wherein the ice dispenser housing is the same or similar color as a wall of a venue when the modular dispensing unit is installed adjacent to or embedded in the wall of the venue.

17. The modular dispensing unit of claim 13, wherein the back side comprises a back wall, and the back wall and the ice dispenser housing are of unitary construction.

18. A modular dispensing unit comprising:

a frame having a front side, back side, two sidewalls, a top wall and a bottom wall, wherein the bottom wall, two sidewalls and top wall are of unitary construction;

a first enclave defined by one of the sidewalls, the back side, the front side, the top wall, an intermediate wall, and an ice dispenser housing sidewall;

a second enclave defined by one of the sidewalls, the back side, the front side, the top wall, an intermediate wall, and a second ice dispenser housing sidewall;

a first beverage dispenser located in the first enclave;

a second beverage dispenser located in the second enclave;

an ice dispenser positioned between the first enclave and the second enclave; and an ice dispenser housing surrounding the ice dispenser and having the two ice dispenser housing sidewalls and a front wall, wherein the front wall has an opening that allows access to an ice outlet of the ice dispenser, and wherein the ice dispenser housing is the same or similar color as a wall of a venue when the modular dispensing unit is installed adjacent to or embedded in the wall of the venue.

19. The modular dispensing unit of claim 18, wherein the bottom wall, two sidewalls, top wall and ice dispenser housing are of unitary construction.

* * * * *